US006425960B1

(12) United States Patent
Yoshizawa et al.

(10) Patent No.: US 6,425,960 B1
(45) Date of Patent: Jul. 30, 2002

(54) SOFT MAGNETIC ALLOY STRIP, MAGNETIC MEMBER USING THE SAME, AND MANUFACTURING METHOD THEREOF

(75) Inventors: Yoshihito Yoshizawa, Fukaya; Yoshio Bizen, Yasugi; Shunsuke Arakawa, Kumagaya; Michihiro Nagao, Yasugi; Takashi Meguro, Yonago, all of (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/549,704

(22) Filed: Apr. 14, 2000

(30) Foreign Application Priority Data

Apr. 15, 1999 (JP) ..... 11-107405

(51) Int. Cl.[7] ..... H01F 1/16; H01F 1/14

(52) U.S. Cl. ..... 148/300; 148/304; 148/306; 148/121

(58) Field of Search ..... 148/100, 121, 148/538, 300, 304, 306, 307, 311, 403; 164/462, 463

(56) References Cited

U.S. PATENT DOCUMENTS

| | | | | |
|---|---|---|---|---|
| 4,288,260 A | * | 9/1981 | Senno et al. | 148/121 |
| 4,881,989 A | | 11/1989 | Yoshizawa | |
| 5,301,742 A | * | 4/1994 | Sato et al. | 164/463 |
| 5,622,768 A | | 4/1997 | Watanabe | |
| 5,658,397 A | * | 8/1997 | Kogiku et al. | 148/304 |
| 5,804,282 A | | 9/1998 | Watanabe | |
| 5,833,769 A | * | 11/1998 | Kogiku et al. | 148/304 |
| 6,103,396 A | * | 8/2000 | Das et al. | 428/611 |

FOREIGN PATENT DOCUMENTS

| | | |
|---|---|---|
| EP | 0 473 782 A | 3/1992 |
| EP | 0 883 551 A | 4/1998 |
| JP | A 55-40023 | 3/1980 |
| JP | A 1-501924 | 7/1989 |
| JP | B 4-4393 | 1/1992 |
| JP | B 2791173 | 6/1998 |
| WO | WO87/06166 | 10/1987 |

OTHER PUBLICATIONS

Matsuki, K. et al., Influence of Surface Roughness on Magnetic Properties of Fe–S–B Amorphous Alloys, IEEE Transactions on Magnetics, US, IEEE Inc. NY, vol. 34, No. 4, Jul. 1998, pp. 1180–1182, XP 000833075, ISSN: 0018–9464.

Proceedings of the Seventh European Magnetic Materials and Applications Conference, Sep. 9–12, 1998, Zaragoza, Spain—Journal of Magnetism and Magnetic Materials, 196–197 (1999) 196–198, I. Todd, H.A. Davies, M.R.J. Gibbs, F. Leccabue, B.E. Watts, "The effect of ambient gases on surface quality and related properties of nanocrystalline soft magnetic ribbons produced by melt spinning".

* cited by examiner

*Primary Examiner*—John Sheehan
(74) *Attorney, Agent, or Firm*—Sughrue Mion, PLLC

(57) ABSTRACT

A soft magnetic alloy strip is manufactured by a single roll method. The soft magnetic alloy strip is 0.2×d mm or less (, which "d" is a width of the strip,) in warpage in the widthwise direction of the strip, and has a continuous, long length not less than 50 m, in which a width of an air pockets occurring on a roll contact face is not more than 35 μm, a length of the air pockets is not more than 150 μm, and the centerline average roughness Ra of the roll contact face is not more than 0.5 μm.

23 Claims, 14 Drawing Sheets

EXAMPLE OF THE INVENTION

COMPARATIVE EXAMPLE

EXAMPLE OF THE INVENTION

SOFT MAGNETIC ALLOY STRIP, MAGNETIC MEMBER USING THE SAME, AND MANUFACTURING METHOD THEREOF

BACKGROUND OF THE INVENTION

The present invention relates to a soft magnetic alloy strip long in length manufactured by a single roll method, in which strip warpage in widthwise direction of the strip is small and superior surface characteristics of the strip are obtained, a magnetic member using the soft magnetic alloy strip, and a manufacturing method of the soft magnetic alloy strip.

A soft magnetic alloy strip such as amorphous alloy, nano-crystalline alloy or the like manufactured by the single roll method is used for a variety of transformers, choke coils, sensors, magnetic shields or the like because of its superior soft magnetic characteristics. As a typical material, a Fe—Cu—(Nb, Ti, Zr, Hf, Mo, W, Ta)—Si—B based alloy or a Fe—Cu—(Nb, Ti, Zr, Hf, Mo, W, Ta)—B based alloy or the like disclosed in JP-B-4-4393 (U.S. Pat. No. 4,881,989) is known. A nano-crystalline soft magnetic alloy is a finely crystallized alloy, and the grain size thereof is about 50 nm or less with good soft magnetic characteristics, in which nano-crystalline alloy thermal instability as found in the amorphous alloy scarcely occurs, and it has high saturation magnetic flux density similar to that of Fe-based amorphous alloy, superior soft magnetic characteristics, and low magnetostriction. Further, it is known that the nano-crystalline soft magnetic alloy is small in change occurring with the elapse of time, and is superior in temperature characteristics.

The single roll method is superior to a method such as a twin roll method in mass productivity, and thus, becomes currently dominant regarding a manufacturing method of an amorphous alloy strip or another amorphous alloy strip for nano-crystalline alloy. FIG. 1 is a schematic view showing an example of a single roll device. A base alloy is melted in a nozzle made of ceramics or quartz, and is pressurized at a pressure p. Then, an alloy melt is ejected from a nozzle slit onto a cooling roll that is rotating at a high speed, and is quenched very rapidly, thereby manufacturing an amorphous alloy strip of about 2 to 100 $\mu$m. The amorphous alloy strip and an amorphous alloy strip for nano-crystalline alloy are produced from a common alloy strip used as a starting material. Therefore, in the present invention, both of these strips are herein-below referred to as a soft magnetic alloy strip.

It is known that the soft magnetic alloy strip produced by the single roll method is required to be cooled as fast as possible to thereby be lowered in temperature in order to prevent the strip from being crystallized and/or embrittlement of the strip.

In addition, in a case where a soft magnetic alloy strip is wider in width, the strip comes into intimate contact with the cooling roll, and it is required to forcibly peel the strip off the roll. With respect to this peeling position, it is generally thought that, since the temperature of the strip is lowered as it is spaced apart from a portion immediately beneath the nozzle, a preferable peeling position is deemed to be one distant as far as possible in view of the generation of amorphous structure or the prevention of embrittlement.

However, in actual manufacture, because of various conditions, there is produced only a strip which is greatly warped in widthwise direction, and moreover which is broken shortly in the longitudinal direction. The warped strip causes a problem that, in the case where the warped strip is wound and laminated, it is difficult to handle the strip, and in the case where a winding magnetic core or laminated magnetic core is manufactured, open spaces occur between the strips, which causes reduction in space factor. In addition, in the case where strip is required to be slit, the strip short in length causes a problem that the times of setting the short strip to a slitter are increased with the result that the cost thereof increases. Further, the warped strip causes another problem that, when the warped strip is forcibly flattened and used, the stress is likely to remain with the result that soft magnetic characteristics are deteriorated.

On the other hand, it is known that air pockets occur, due to entrainment of air, on the strip surface (hereinafter, referred to as "a roll contact face") which is in contact with roll. FIG. 2 is a schematic view showing dimensions of the air pockets occurring on the roll contact face. This air pocket is generally a recess having a shape extended in the longitudinal direction of the strip. Thus, when this strip is used for a magnetic core, it will cause reduction of the space factor. Thus, it is important to reduce the number of air pockets as small as possible. However, in mass production for manufacturing a much amount of wide strip, superior magnetic characteristics which should occur inherently cannot be obtained insofar as mere reducing of the number of air pockets and mere reducing of an area rate of the air pockets are concerned.

It was found that the influence of these warps and/or air pockets become significant in the case where mass production of Fe—(Cu, Au)—M—Si—B based or Fe—(cu, Au)—M—B based amorphous alloy strip wide in width which is a base material of a Fe-group nano-crystal soft magnetic alloy strip is performed. In addition, even if the strip is used for a magnetic core or the like in amorphous state, it is found that there occurs a problem that the magnetic characteristics at a low frequency are particularly deteriorated due to crystallization of the air pocket portion.

SUMMARY OF THE INVENTION

It is an object of the present invention to provide a wide, less warped soft magnetic alloy strip long in length manufactured by the single roll method as a soft magnetic alloy strip with reduced air pocket size and with reduced recess on the roll contact face side, and further, a magnetic member with its improved space factor and soft magnetic characteristics using this strip and a manufacturing method of the soft magnetic alloy strip.

The inventors found out the factors of the occurrence of warpage of the soft magnetic alloy strip and of the occurrence of air pockets at the time of the manufacturing thereof, and succeeded in restricting the warpage and air pockets to particular degrees, whereby solving the foregoing problem. First, warpage of the strip also occurs in the longitudinal direction of the strip, however, attention is focused on the warpage in widthwise direction here. As regards a strip narrow in width, widthwise warpage hardly causes problem, however, it becomes serious if manufacturing condition is not proper in a case of a wide strip. In particular, warpage occurs more remarkably in the case where the thickness of the strip is thin. As regards a soft magnetic alloy strip preferably employed for various magnetic members such as magnetic core, it is preferred for the warpage to be limited in a range not more than 0.2×d mm in widthwise direction of the strip when the strip has a width of d mm, and further it is preferred for the strip to have such a long, successive length as to be not less than 50 m. In addition, when the thickness of this strip is 25 $\mu$m or less and the width d is 10 mm or more, and further, even when the thickness of the strip is 20 μm or less and the width d is 20 mm or more, it is preferred for the degree of the warpage to be limited to the range defined above.

In conventional manufacturing conditions, it is impossible to obtain a strip having the degree of warpage and length both limited above. For example, if a roll temperature is too low, it has been found that the strip warps. This reason is not well understood, however, it is presumed that the solidification of molten alloy occurs in the vicinity of a nozzle at a time when the molten alloy ejected from the nozzle solidifies on a roll to thereby become amorphous and the temperature distribution of the resultant strip relates to this warpage. In addition, it has been found out that, if a distance between a portion of a strip immediately beneath the nozzle and the peeling-off point of the strip is not appropriate, the strip breaks during the production of the strip wide in width, so that continuous, long strip cannot be manufactured.

According to the first aspect of the invention, there is provided a soft magnetic alloy strip produced by a single roll method in which a molten alloy is ejected onto a rotating, cooling roll from a nozzle having a slit and in which the surface temperature of the cooling roll after the elapse of 5 seconds or more after the molten metal was ejected is maintained to be not less than 80° C. but not more than 300° C. while performing the peeling-off of the alloy strip at a distance ranging from 100 mm to 1500 mm when measured from a position of the outer circumference of the roll just beneath the nozzle slit along the circumference of the roll, whereby it becomes possible to produce a soft magnetic alloy strip of a continuous length not less than 50 m in which warpage is restricted to be not more than 0.2×d mm (which "d" is the width of the strip). In a case where magnetic cores or the like are manufactured by using this strip, it is possible to manufacture the magnetic cores or the like having high dimensional precision, high space factor, and superior soft magnetic property. Incidentally, these warpages are prescribed in a strip state after production of the amorphous alloy strip, not warpage occurring after heat treatment or working or using for a magnetic core.

Another aspect of the invention relates to surface characteristics of a roll contact face. The invention has been achieved from the findings that, when roll temperature rises during the strip manufacture, each of air pocket portions each having a large size is crystallized with the result that the magnetic characteristics are deteriorated and that, unless surface roughness Ra correlating with a depth of a recess of an air picket is reduced, the magnetic characteristics are deteriorated.

That is, a soft magnetic alloy strip having the width of the air pockets of not more than 35 μm on the roll contact face, the length of the air pocket of not more than 150 μm and the centerline average roughness Ra of not more than 0.5 μm on the roll contact face is preferred in the view of superior soft magnetic characteristics and good space factor.

The inventors have further found out that the surface characteristics of the roll contact face are particularly important from the viewpoint of the magnetic performance. In this respect, the inventors have found that molten metal-ejecting pressure, a peripheral speed of the cooling roll and an interval between the cooling roll and a nozzle tip end are important during the production of the strip. That is, the alloy melt is ejected on the rotating cooling roll made of a metal from a nozzle having a slit, and an alloy strip is manufactured by the single roll method, wherein molten metal-ejecting pressure during the ejecting of the molten metal is controlled to be 270 gf/cm$^2$ or more, the peripheral speed of the cooling roll being controlled to be 22 m/s or more, and preferably, an interval between the cooling roll and the nozzle tip end is made to be not less than 20 μm but not more than 200 μm, so that the strip can be manufactured with high quality, high stability, and in mass production.

Although many air pockets on the roll control face are caused and vary in size, the width of the air pockets prescribed in the invention is the largest width (W) in the air pockets when measured within the range of 0.4 mm×0.5 mm on the roll contact face, and a length of air pockets is the longest length (L) in the air pockets when measured within the range of 0.4 mm×0.5 mm on the roll contact face. W and L are defined schematically in FIG. 2. Further, the centerline average roughness Ra of the roll contact face is a value defined by making the cut-off value λc prescribed in JIS B 0601 be 0.8 in the widthwise direction of the soft magnetic alloy strip and by making measurement length be at least 5 times the cut-off value.

Figure 1:
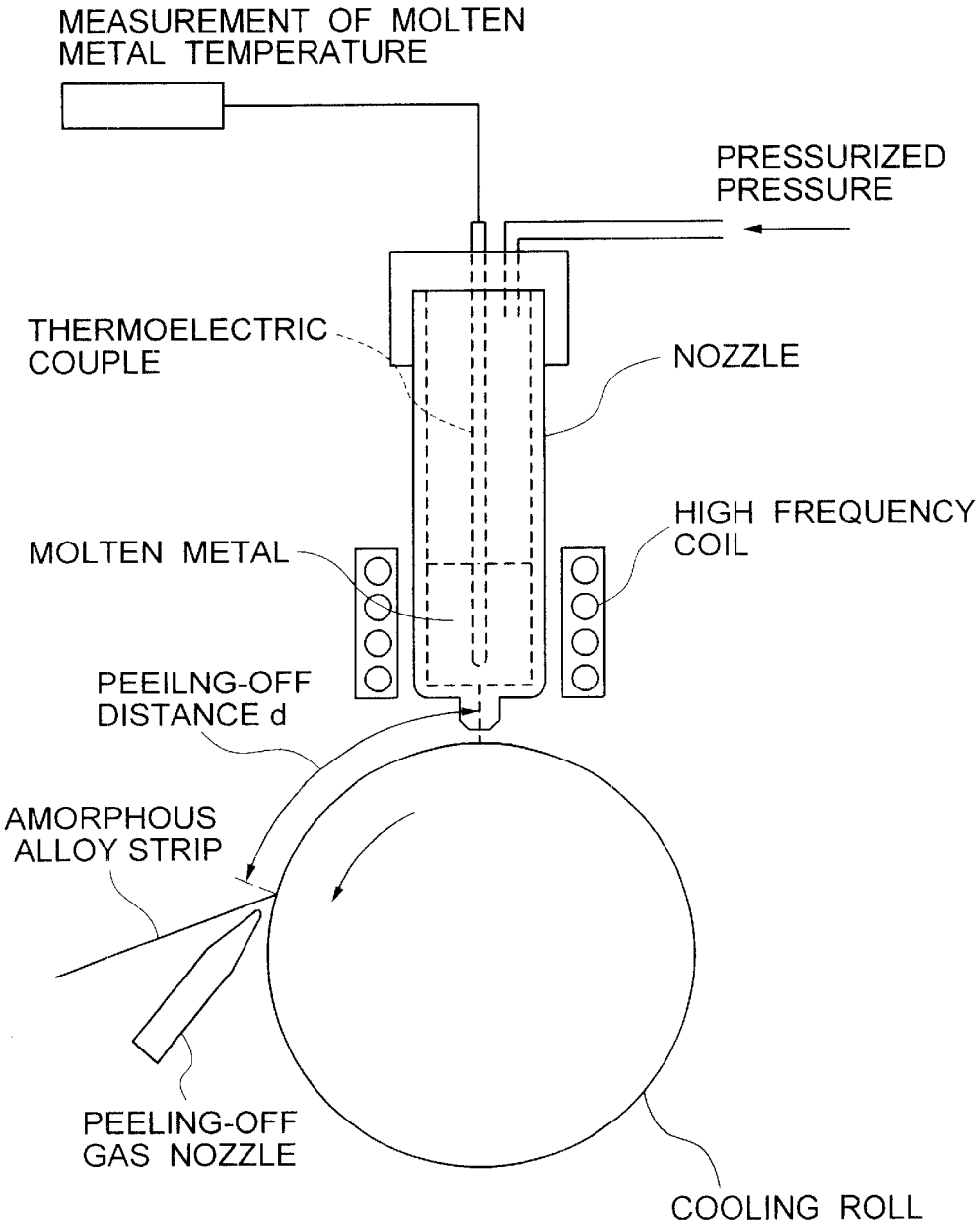
FIG. 1 is a schematic view showing a single roll device for manufacturing a soft magnetic alloy strip according to the invention.
Figure 2:
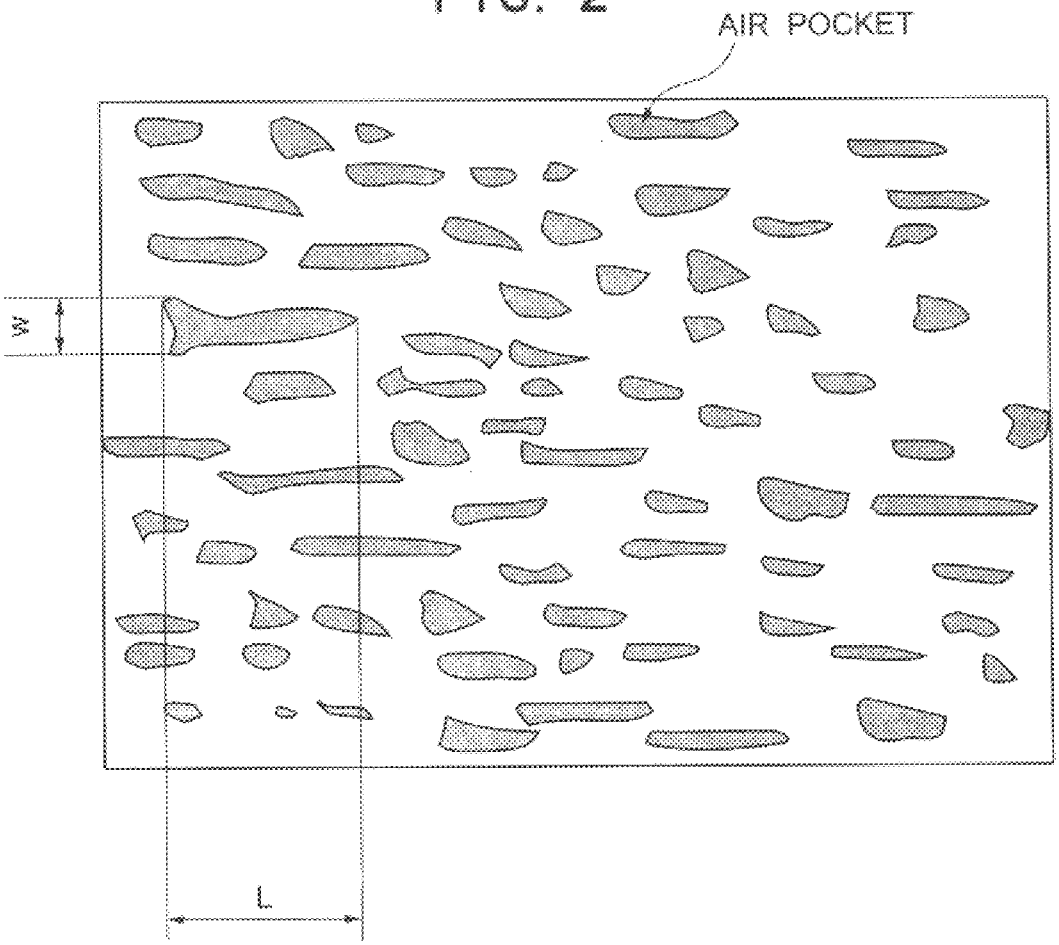
FIG. 2 is a schematic view showing the shape of air pockets occurring on the roll control face side of the soft magnetic alloy strip according to the invention.

PREFERRED EMBODIMENTS OF THE INVENTION (A) Composition

A starting material of the soft magnetic alloy strip according to the invention may be any one of the Fe-based amorphous alloy and Co-based amorphous alloy. A typical Co-based amorphous alloy is represented by compositional formula: $Co_{100-x-y}M_xX_y$ (atomic %), wherein M is at least one element selected from the group consisting of Ti, Zr, Hf, Mo, Nb, Ta, W, V, Cr, Mn, Ni, Fe, Zn, In, Sn, Cu, Au, Ag, platinum group elements, and Sc; X being at least one element selected from the group consisting of Si, B, Ga, Ge, P, and C; x and y being $0 \leqq x \leqq 15$, $5 \leqq y \leqq 30$, and $10 \leqq x+y \leqq 30$. As a material of the soft magnetic alloy strip, an alloy including Fe of not less than 0 atomic % but not more than 10 atomic % and Mn of not less than 0 atomic % but not more than 10 atomic % is preferred.

As a typical Fe-based amorphous alloy is represented by compositional formula: $Fe_{100-x-a-y-z}A_xM_aSi_yB_z$ (atomic %), wherein A is at least one element selected from the group consisting of Cu and Au; M being at least one element selected from the group consisting of Ti, Zr, Hf, Mo, Nb, Ta, W, Nb and V; x, y and z being $0 \leqq x \leqq 3$, $0 \leqq a \leqq 10$, $0 \leqq y \leqq 2$, and $2 \leqq z \leqq 25$, respectively. In the case of this alloy, the dependence on manufacturing conditions is great, and in particular, the effect of the invention is remarkable. Here, a part of Fe may be replaced by at least one element selected from the group consisting of Co and Ni; a part of B may be replaced by at least one element selected from the group consisting of Al, Ga, Ge, P, C, Be, and N; and a part of M may be replaced by at least one element selected from the group consisting of Mn, Cr, Ag, Zn, Sn, In, As, Sb, Sc, Y, platinum group elements, Ca, Na, Ba, Sr, Li, and rare earth elements.

The letter "A" denotes at least one element selected from Cu and Au, and particularly superior effect can be obtained when the manufactured amorphous alloy strip is crystallized by heat treatment and when it is used as a nano-crystalline magnetic material. That is, this heat treatment brings about such effects as crystal grains are made to be fine in grain size and as the magnetic permeability is improved, so that superior soft magnetic characteristics can be achieved when it is made to be a nano-crystal magnetic material. The amount "x" of "A" is preferred to be $0.1 \leqq x \leqq 3$.

M and B are elements each having an effect of promoting the occurrence of amorphous structure. The Si amount y is preferably 20 atomic % or less. If the Si amount exceeds 20%, the strip becomes brittle, making it difficult to manufacture a continuous strip. It is preferred that the B amount z is not less than 2 atomic % but not more than 25 atomic %. If the B amount z is less than 2 atomic %, the flow of molten alloy becomes lowered, the productivity being lowered unfavorably. If it exceeds 25 atomic %, the strip is apt to be brittle unfavorably. The more preferable range of the B amount z is 4 to 15 atomic %. An alloy strip with small warpage can be obtained in this range. The particularly preferred range of B amount z is 6 to 12 atomic %. An alloy strip with particularly small warpage is likely to be obtained in this range.

In the invention, the alloy strip may contain incidental impurities such as N, O, S mixed therein from surrounding gases, refractory and the raw material.

(B) Manufacturing Method for Reducing Degree of Warpage

This manufacturing method is based on the single roll method in which alloy melt is ejected from a nozzle having a slit onto a rotating metallic cooling roll. It is necessary to perform the method under the conditions that the surface temperature of the cooling roll in a period of time elapsing 5 seconds or more after the melt was discharged is kept to be not less than 80° C. but not more than 300° C. and that the peeling-off of the alloy strip from the cooling roll is performed at a distance within the range of 100 mm to 1500 mm measured from a position of the circumference of the roll immediately beneath the nozzle slit. If the elapse of a period of time is less than 5 seconds after starting the ejecting of the molten alloy, the roll temperature and the pressure suddenly changes, and no intimate contact between the strip and the roll is obtained, thus making the quality unstable. Although a relationship between the warpage, the breakage and the production conditions is not clear, in the case of 5 seconds or more, the change of the roll surface temperature and the molten alloy-discharging pressure become stable, and the warpage and breakage are deemed to depend on the manufacturing conditions. As regards the peeling-off distance from the cooling roll of the strip, in the case where it is selected to be in the range of 150 mm to 1000 mm in particular, breakage hardly occurs, making it possible to manufacture a continuous strip with its length of 200 m or more in longitudinal direction. At this time, the peeling-off of the strip from the roll is generally performed by blowing a gas such as air, nitrogen, argon onto the roll surface. In a case of mass-producing the strip, the strip after the peeling-off is wound around a roll. In view of the winding of the strip, it is not preferable that the strip is apt to break. In the mass-production thereof, it is essential to produce a continuous strip with good quality in a steady-state, and the effect of the present invention is also remarkable in view of this respect.

Further, the cooling roll surface temperature is particularly kept to be not less than 100° C. but not more than 250° C., thereby making it possible to manufacture a long alloy strip that is hardly brittle and that has small warpage of 0.1×d mm or less (which "d" is the width of the strip) in the widthwise direction of the strip. The metallic cooling roll is usually water-cooled in the case of the mass production of the strip, however, the temperature of water for cooling the roll may be raised as required. In the cases where the Cu alloy such as Cu, Cu—Be, Cu—Zr, or Cu—Cr having higher cooling capability is used for the cooling roll and where a wide strip is manufactured, the preferable result is obtained. In particular, in the case where the quantity of the water for cooling the roll is not less than 0.1 $m^3$/minute but not more than 10 $m^3$/minute, a strip almost free of warpage, breakage, brittleness or the like can be manufactured even when the amount of the production becomes such a high level as to be not less than 5 kg. A preferable water quantity in a case of manufacturing a particularly thin strip is not less than 0.1 $m^3$/minute but not more than 1 $m^3$/minute. In addition, the diameter of the cooling roll is usually about 300 mm to 1200 mm. Preferably, the diameter is about 400 mm to 1000 mm. In particular, the diameter is preferred to be 500 mm to 800 mm.

(C) Manufacturing Method for Reducing Air Pockets and Surface Roughness

This manufacturing method is based on the single roll method in which the alloy melt is ejected from a nozzle with a slit onto a rotating metallic cooling roll, wherein melt-ejecting pressure during discharge of the alloy melt is required to be not less than 270 gf/$cm^2$, and the peripheral speed of the cooling roll is required to be not less than 22 m/s.

The soft magnetic alloy strip of the invention, as in the above mentioned manufacturing method, is manufactured by a so-called single roll method in which the alloy melt heated at a temperature not less than the melting point (about 1000° C. to 1500° C. in usual Fe-based or Co-based materials) is ejected from the nozzle with the slit onto a metallic cooling roll. The nozzle slit used for ejecting the molten alloy is preferably provided with a shape corresponding to the cross section of the strip to be manufactured. The nozzle is made of ceramics such as quartz, silicon nitride, BN or the like. A plurality of slits may be used to produce the strip. In this single roll method, an interval (a gap) between the cooling roll and the nozzle tip end during discharge of the alloy melt is not less than 20 μm but not more than 500 μm, and is usually not more than 250 μm. Particularly, by setting this interval to be not less than 20 μm but not more than 200 μm and by setting the ejected molten alloy pressure to be not less than 270 gf/cm$^2$ while selecting the peripheral speed of the cooling roll to be not less than 22 m/s, it becomes possible to achieve the width of air pockets not more than 35 μm which are occur on the roll contact face of the strip, length of the air pockets not more than 150 μm or less and the centerline average roughness Ra not more than 0.5 μm. The particularly preferable molten alloy-ejecting pressure is not less than 350 gf/cm$^2$ but not more than 450 gf/cm$^2$, the particularly preferable peripheral speed of the cooling roll being not less than 22 m/s but not more than 40 m/s, and in this range, the particularly high permeability is readily obtainable. The production of the strip may be carried out in an inert gas such as He or Ar as required. In addition, in a case where He gas, CO gas, or $CO_2$ gas is made to flow in the vicinity of the nozzle during the manufacture, the face of the strip comes to have improved quality, and the preferable result is obtained.

Of course, in actual manufacture, it is effective to perform a manufacturing method having such conditions as to meet the reducing of the above described warpage and as to simultaneously reduce the air pockets and surface roughness.

(D) Heat Treatment

In the case where a magnetic member such as, for example, magnetic core etc. is manufactured by using the above obtained soft magnetic alloy strip, the manufactured soft magnetic alloy strip in an amorphous state is wound or laminated to make a magnetic core shape, and then is heat-treated. When this member is used as an amorphous alloy magnetic core, it is usually heat treated at a temperature less than the crystallization temperature. On the other hand, when the magnetic member is used as a nano-crystalline soft magnetic alloy core, it is usually heated up to a temperature not less than the crystallization temperature so that a part of (, preferably 50% or more of) the crystal grains of 50 nm or less in average grain size may be precipitated, and thereafter the strip is used as a magnetic core.

The heat treatment is usually performed in an inert gas such as argon or nitrogen gas however, the heat treatment may be performed in an atmosphere containing oxygen or in vacuum. Further, a magnetic field having such intensity as magnetic flux in the alloy is substantially saturated may be applied during at least a part of the heat treatment period as required, that is, heat treatment in the magnetic field may be performed so that induced magnetic anisotropy may be imparted. In general, a magnetic field of 8 A/m or more is often applied when the magnetic field is applied in the longitudinal direction of the strip (in the magnetic path direction of the magnetic core in a case of a wound magnetic core) in order to obtain a high squareness, or a magnetic field of 80 kA/m or more is often applied when the magnetic field is applied in the widthwise direction of the strip (in the direction of the height of the magnetic care in a case of the wound magnetic core) in order to obtain a low squareness. Heat treatment is preferably performed in an inert gas atmosphere having dew point of −30° C. or less. In particular, when heat treatment is performed in an inert gas atmosphere having dew point of −60° C. or less, the magnetic permeability becomes higher, and the more preferable result can be obtained for uses requiring high magnetic permeability. In the case where the heat treatment is performed in such a heat treatment pattern as to be maintained at a constant temperature, the maintaining period of time at a certain temperature is usually 24 hours or less from the viewpoint of mass productivity, and preferably 4 hours or less. The average temperature rise rate during the heat treatment is preferably in a range of 0.1° C./min to 200° C./min, and more preferably 1° C./min to 40° C./min, the average cooling speed being preferably in a range of 0.1° C./min to 3000° C./min and more preferably 1° C./min to 1000° C./min, and in this range, particularly superior magnetic characteristics can be obtained.

Further, in the case where the alloy strip according to the invention is heat treated, multiple-stage heat treatment or a plurality of times of heat treatment may be performed instead of the single-stage heat treatment. Further, DC, AC or pulse current may be supplied to the amorphous alloy strip so that heat occurs therein, while the alloy strip is heat treated. Furthermore, while tensile stress or pressure is applied to the alloy strip, heat treatment may be performed so that anisotropy is imparted, thereby making it possible to improve the magnetic characteristics.

(E) Magnetic Member and the Use

In the soft magnetic alloy strip according to the invention, the surface of the alloy strip may be covered with powders or film such as $SiO_2$, MgO, $Al_2O_3$ or the like as required, or an insulation layer may be formed on the surface by chemical conversion treatment; or an oxide layer may be formed on the surface by anode oxidization processing so that an inter-layer insulation may be formed. The inter-layer insulation processing can bring about, when the alloy strip according to the invention is used as a magnetic core, such advantages as influence of eddy current is reduced particularly at high frequency and as magnetic permeability and magnetic core loss are further improved. As regards the produced alloy strip wide in width, there is a case in which slits each having a proper width are formed in the alloy strip as occasion demands. Thus, the alloy strip having the slits is, of course, included in the scope of the invention. The alloy strip according to the invention may be used to produce a composite sheet in which the amorphous alloy strip or the nano-crystalline alloy strip prepared from the amorphous alloy strip used as a starting material is compounded in a sheet-shaped resin, or may be used to produce a composite sheet or a composite block which is formed by the steps of comminuting the alloy strip of the invention or the nano-crystalline alloy strip prepared therefrom to thereby make flakes or powder, and compounding it with resin to thereby produce the sheet or block. The alloy strip of the invention can be also used for producing a shield material or a wave absorber or the like.

Also, the soft magnetic alloy strip according to the invention can be used for a magnetic sensor such as burglarproof sensor or identification sensor. Further, after working to the magnetic member, it may be possible to perform resin impregnation, coating, cutting after resin impregnation or the like is possible as required. The soft magnetic alloy strip can be used to provide the magnetic core of each of a transformer, choke coil, saturable reactor, sensor, and devices using the magnetic members disclosed above, such as power source, inverter, earth leakage breaker, personal computer, and communication devices which enable the miniaturization thereof, improvement of the efficiency, and/or the noise reduction thereof.

(F) Embodiments

Hereinafter, the present invention will be described in accordance with Embodiments, however, the scope of the invention is not limited thereto.

(Embodiment 1)

By using a single roll device similar to that shown in FIG. 1, an alloy melt consisting essentially of Si: 15.5 atomic %; B: 6.7%; Nb: 2.9 atomic %; Cu: 0.9 atomic %; and the balance being substantially Fe was ejected from a nozzle made of ceramic containing as the main component thereof silicon nitride, onto a cooling roll of 900 mm in outer diameter which is made of Cu—Be alloy, so that alloy strip of 10 kg having an amorphous state and a width of 25 mm was produced. The ejecting temperature of the melt was 1300° C.; the size of a nozzle slit was 25 mm×0.6 mm; a gap between the nozzle tip end and the cooling roll was 100 μm, the cooling roll surface temperature was changed by heating the surface of the roll; and the cooled alloy on the roll surface was peeled off at a position of 630 mm spaced apart from a location just beneath the nozzle slit along the circumference of the roll, so that a strip in amorphous state of 25 mm in width was fabricated. The temperature of the cooling roll surface was successively measured by an infrared radiation temperature meter at a position distant by 100 mm from the nozzle position in a direction opposite to the direction in which the strip was produced. The cooling roll temperature was obtained by compensating roll temperatures actually measured during the production while using the temperature variation of the roll surface which had been previously measured by heating the roll.

Figure 3:
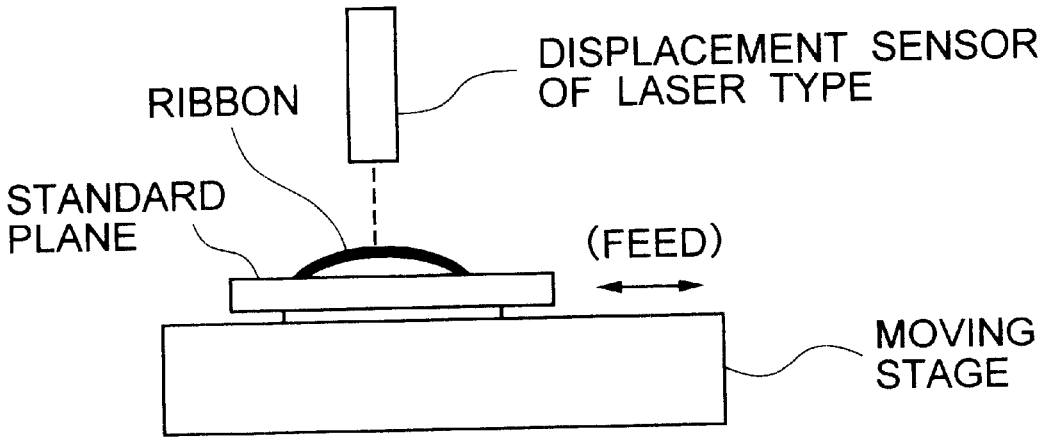
FIG. 3 is a view schematically showing warpage amount-measuring instrument of the soft magnetic alloy strip according to the invention.
Figure 4:
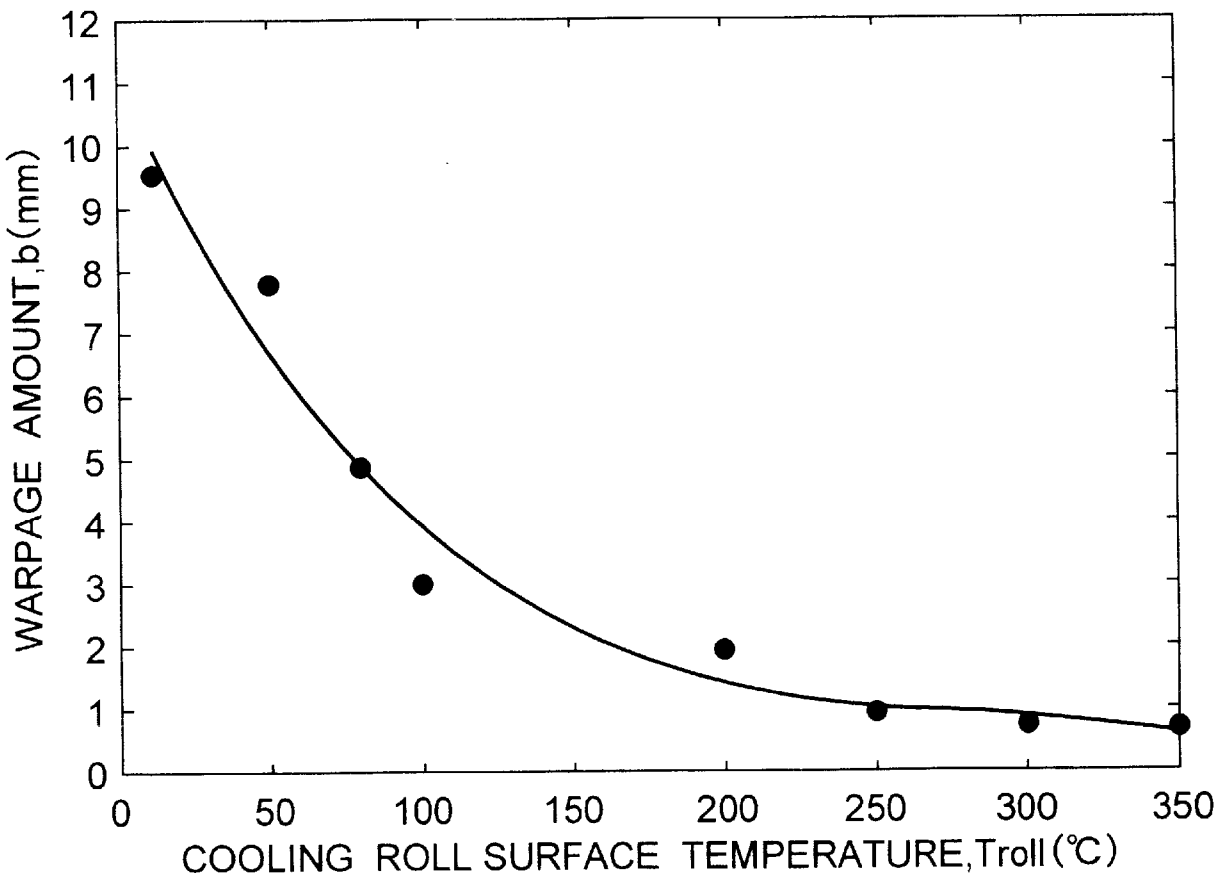
FIG. 4 is a graph depicting an example of a relationship between the warpage amount of the soft magnetic alloy strip of the invention and cooling roll surface temperature.

Next, the strip was cut at a position corresponding to 30 seconds elapsing after the commencement of the manufacturing of this strip, so that samples of 25 mm in width, 5 mm in length, and 18 μm in thickness were produced, and warpage in the strip in widthwise direction was measured by laser beam measurement. The measurement method is shown in FIG. 3. In the drawing, the maximum height from a reference face was defined as the warpage of the strip. The warpage in the strip direction was measured along the strip centerline by moving a stage in widthwise direction. FIG. 4 shows a relation between the amount of warpage of the strip occurring at a position corresponding to the lapse of 30 seconds after the commencement of the manufacture of the strip and a cooling roll surface temperature after elapsing 30 seconds after the commencement of the manufacture of the strip. When the cooling roll surface temperature was less than 80° C., the strip warpage was unfavorably in excess of 5 mm. In a case where it was more than 300° C., the strip unfavorably became brittle although the amount of the warpage was small.

(Embodiment 2)

The same single roll device as that shown in FIG. 1 was used, and a strip was fabricated under the same composition and manufacturing conditions as those of Embodiment 1. In this Embodiment, a distance was varied which was measured along the circumference of the roll between the circumferential position of the roll immediately beneath the nozzle slit and the position at which the strip was peeled off the roll, so that the strip of 10 kg in amorphous state of 25 mm in width was fabricated. The roll surface temperature at 5 seconds after the manufacture of the strip had been started was 180° C., and the temperature at the end of the manufacture of the strip was 210° C.

Figure 5:
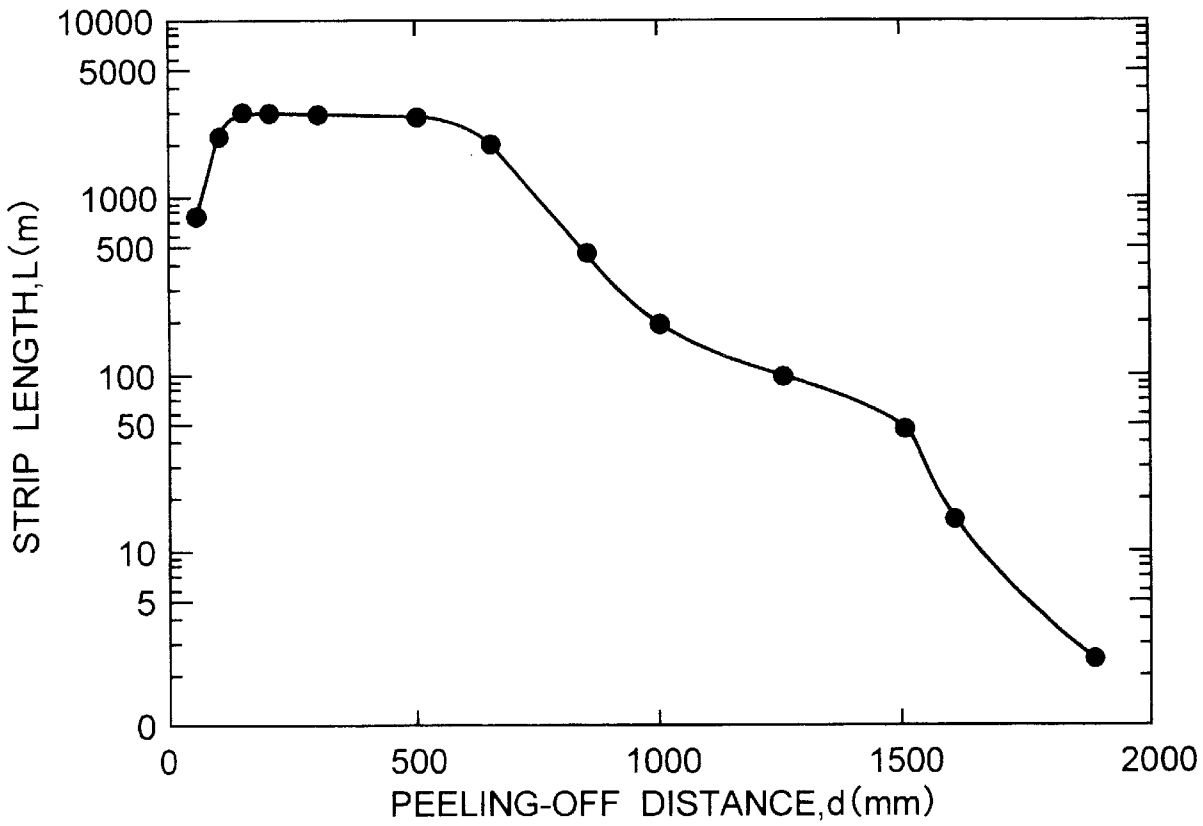
FIG. 5 is a graph depicting an example of a relationship between a length and a peeling-off distance relating to the soft magnetic alloy strip according to the invention.

In this Embodiment, a length of the fabricated strip was measured. In the case of the occurrence of breakage, a length of the longest continuous strip was measured. FIG. 5 shows a relationship between the length of the strip and the distance of the peeling-off. When the peeling-off distance d is less than 100 mm, the strip becomes unfavorably brittle. In excess of 1500 mm, the strip is apt to be readily broken, making it difficult to manufacture a continuous stripe with a length of 50 m or more, and the mass production thereof is difficult. A peeling-off range from 150 mm to 1000 mm is preferable because an long continuous strip of 100 m or more in length can be manufactured. Particularly preferably, a long continuous strip is obtained in the peeling-off range from 150 mm to 650 mm, and a strip having a length in excess of 1000 m can be manufactured.

From the foregoing, by producing the strip under such conditions as the surface temperature of the cooling roll is kept to be not more than 80° C. but not less than 300° C. and as the strip is peeled off the roll within the range from 100 mm to 1500 mm which is measured circumferentially between the roll position immediately beneath the nozzle and the position of the peeling-off of the strip, thereby making it possible to manufacture a long strip with small warpage.

(Embodiment 3)

By using the same single roll device as that shown in FIG. 1, strips of 10 kg each having an amorphous state and a width of each of 7.5 mm, 10 mm, 20 mm and 30 mm were produced by the steps of preparing a molten alloy consisting, by atomic %, of Si: 13.5%; B: 8.7%; Nb: 2.5%; Mo: 0.5%; Cu: 0.8%; and the balance substantially Fe, and ejecting the molten alloy from a ceramics nozzle of silicon nitride onto the Cu—Be alloy cooling roll of 600 mm in outer diameter, whereby the alloy strips having various thicknesses were produced. The production of the alloy strips was performed under such conditions as the temperature of the ejecting of the molten alloy was 1300° C., a gap between the nozzle tip end and the cooling roll being 100 μm, the cooling roll surface temperature being 190° C. and 300° C. (comparative Example), and the peeling-off was performed at a position distant by 630 mm when measured from the roll position immediately beneath the nozzle slit along the roll circumference, whereby the strip in amorphous state of 25 mm in width was fabricated. The cooling roll surface temperature was measured in the same manner as that of Embodiment 1.

Next, a part of this alloy strip was cut, so that there were prepared samples having dimensions of the above widths, length of 5 mm and various thicknesses, and warpage in the widthwise direction of the samples was measured by laser beam measurement in the same manner as that of Embodiment 1. Table 1 shows the amount of the warpage of the samples.

TABLE 1

| No. | Strip width (mm) | Strip thickness (μm) | Sample of the invention: Roll surface temperature (° C.) | Sample of the invention: Warpage of strip (mm) | Comparative samples: Roll surface temperature (° C.) | Comparative samples: Warpage of strip (mm) |
|---|---|---|---|---|---|---|
| 1 | 7.5 | 15 | 190 | 0.3 | 30 | 2.1 |
| 2 | 7.5 | 20 | 190 | 0.2 | 30 | 1.9 |
| 3 | 7.5 | 25 | 190 | 0.2 | 30 | 1.8 |
| 4 | 7.5 | 27 | 190 | 0.1 | 30 | 1.6 |
| 5 | 10 | 15 | 190 | 0.4 | 30 | 3.3 |
| 6 | 10 | 18 | 190 | 0.4 | 30 | 3.1 |
| 7 | 10 | 20 | 190 | 0.3 | 30 | 2.7 |
| 8 | 10 | 25 | 190 | 0.2 | 30 | 2.4 |
| 9 | 10 | 27 | 190 | 0.2 | 30 | 2.1 |
| 10 | 20 | 15 | 190 | 0.8 | 30 | 7.5 |
| 11 | 20 | 20 | 190 | 0.7 | 30 | 6.3 |
| 12 | 20 | 25 | 190 | 0.6 | 30 | 5.2 |
| 13 | 20 | 27 | 190 | 0.5 | 30 | 4.2 |
| 14 | 30 | 15 | 190 | 1.2 | 30 | 12.2 |
| 15 | 30 | 20 | 190 | 0.9 | 30 | 10.2 |
| 16 | 30 | 25 | 190 | 0.8 | 30 | 8.0 |
| 17 | 30 | 27 | 190 | 0.7 | 30 | 6.8 |

In the case where the width of the strip is 10 mm or more, the warpage becomes remarkable in the manufacturing method other than that of the present invention; and in particular, in the case where the width of strip is not less than 20 mm, the advantage of the invention is remarkable. In addition, the thinner the strip thickness is, the more the strip is apt to be influenced by the roll temperature, making the advantage of the invention remarkable. The advantage of the invention becomes more remarkable in a case of strip thickness of 25 μm or less. In particular, the advantage of the invention becomes most remarkable in a case of strip thickness of 20 μm or less.

(Embodiment 4)

Soft magnetic alloy strips of various compositions shown in Table 2 were fabricated by the same single roll method as that shown in FIG. 1 according to both of the manufacturing method of the invention and a manufacturing method other than that of the invention. The amounts of melt was 8 kg in the case of 20 mm in strip width, 10 kg in the case of 25 mm in strip width, 12 kg in the case of 30 mm in strip width, 7.1 kg in the case of 25 mm in strip width, 20 kg in the case of 50 mm in strip width, and 40 kg in the case of 100 mm in strip width. During the production of the strips were measured the roll surface temperature, the warpage of the strip, and length of the fabricated strips. In the case of the occurrence of breakage, the length of the longest continuous strip was measured in the broken strips. In addition, the manufactured alloy strips were wound to thereby be formed into wound magnetic cares having an outer diameter of 50 mm and an inner diameter of 45 mm, and the soft magnetic characteristics of the magnetic cores were measured. The above measurement results are shown in Table 2.

TABLE 2

| No. | Composition (at %) | Strip width (mm) | Strip thickness (μm) | Example of the invention: Roll surface temperature (° C.) | Example of the invention: Peeling-off distance d (mm) | Example of the invention: Strip warpage b (mm) | Example of the invention: Strip length (m) | Example of the invention: Relative magnetic permeability (1 kHz) |
|---|---|---|---|---|---|---|---|---|
| 1 | $Fe_{bal}Cu_1Nb_2Si_{12}B_9$ | 30 | 18 | 180 | 650 | 1.1 | 2840 | 98000 |
| 2 | $Fe_{bal}Cu_{0.4}Nb_2Ta_{0.6}Si_{10}B_{11}$ | 30 | 18 | 180 | 650 | 1.0 | 2860 | 89000 |
| 3 | $Fe_{bal}Cu_1Mo_{3.6}Si_{15}B_8V_{0.6}Sn_{0.1}$ | 30 | 16 | 190 | 600 | 1.2 | 2800 | 82000 |
| 4 | $Fe_{bal}Cu_1Nb_{2.6}Si_{15.8}B_6Mn_1$ | 25 | 17 | 200 | 680 | 0.9 | 2750 | 101000 |
| 5 | $Fe_{bal}Au_{0.5}W_{3.5}Si_{14}B_9Ga_{0.2}Zn_{0.1}$ | 35 | 17 | 180 | 550 | 1.2 | 2880 | 79000 |
| 6 | $Fe_{bal}Ni_5Cu_{0.6}Nb_{2.6}Si_{10}B_{12}P_1$ | 30 | 18 | 160 | 600 | 1.1 | 2860 | 77000 |
| 7 | $Fe_{bal}Co_{30}Cu_1Nb_{2.6}Si_{5.6}B_9$ | 25 | 18 | 220 | 650 | 0.8 | 2890 | 22000 |
| 8 | $Fe_{bal}Cu_{0.5}Nb_2Si_{14}B_9Al_2Ag_{0.1}$ | 20 | 15 | 200 | 690 | 0.8 | 3540 | 79000 |
| 9 | $Fe_{bal}Cu_{0.6}Nb_3Si_{10}B_{11}Ge_1$ | 25 | 16 | 210 | 650 | 1.0 | 3290 | 97000 |
| 10 | $Fe_{bal}Cu_1Nb_4Hf_{0.5}Zr_{2.5}B_8$ | 20 | 20 | 200 | 700 | 0.7 | 2710 | 72000 |
| 11 | $Fe_{bal}Ni_{30}Mo_5B_{14}$ | 30 | 25 | 240 | 600 | 0.6 | 1780 | 7200 |
| 12 | $Fe_{bal}Co_{20}B_{14}Si_4C_{0.6}$ | 40 | 25 | 210 | 560 | 0.8 | 1770 | 3800 |
| 13 | $Cu_{bal}Ag_{10}P_{14}$ | 50 | 20 | 210 | 540 | 1.5 | 2700 | — |
| 14 | $Ni_{bal}Si_{10}B_{16}Cr_3$ | 100 | 20 | 220 | 500 | 2.8 | 2690 | — |
| 15 | $Co_{bal}Fe_4Mo_2Si_{14.6}B_{11}$ | 100 | 20 | 220 | 450 | 2.9 | 2680 | 102000 |
| 16 | $Fe_{bal}Nb_7B_9$ | 40 | 20 | 200 | 550 | 1.4 | 2690 | 18000 |
| 17 | $Co_{bal}Fe_4Ni_{10}Nb_3Si_{15}B_{10}$ | 100 | 20 | 280 | 500 | 2.7 | 2710 | 98000 |

TABLE 2-continued

| | | | | | | | | |
|---|---|---|---|---|---|---|---|---|
| 18 | $Fe_{bal}P_4C_5B_{14}$ | 25 | 18 | 200 | 650 | 0.9 | 2860 | 2800 |
| 19 | $Fe_{bal}Cu_1Mo_3Si_{15}B_{10}C_1$ | 25 | 18 | 190 | 650 | 0.9 | 2850 | 72000 |
| 20 | $Fe_{bal}Co_{25}Ni_{15}Si_2B_{15}$ | 25 | 20 | 220 | 650 | 0.8 | 2680 | 3200 |

| | Comparative Example | | | | |
|---|---|---|---|---|---|
| No. | Roll surface temperature (° C.) | Peeling-off distance d (mm) | Strip warpage b (mm) | Strip length (m) | Relative magnetic permeability (1 kHz) |
| 1 | 45 | 1800 | 12.3 | 2.1 | 67000 |
| 2 | 41 | 1800 | 12.1 | 2.2 | 62000 |
| 3 | 55 | 1800 | 12.6 | 2.5 | 59000 |
| 4 | 60 | 1700 | 10.4 | 2.6 | 72000 |
| 5 | 65 | 1600 | 14.4 | 2.8 | 61000 |
| 6 | 70 | 1550 | 12.2 | 3.0 | 60000 |
| 7 | 72 | 1900 | 10.1 | 2.1 | 13000 |
| 8 | 50 | 1900 | 8.5 | 2.1 | 63000 |
| 9 | 48 | 1800 | 10.6 | 2.0 | 68000 |
| 10 | 45 | 1700 | 7.8 | 2.7 | 6000 |
| 11 | 40 | 1750 | 10.3 | 2.6 | 3800 |
| 12 | 35 | 1800 | 13.7 | 2.5 | 1800 |
| 13 | 40 | 1750 | 35.1 | 2.6 | — |
| 14 | 38 | 1700 | 70.3 | 2.7 | — |
| 15 | 39 | 1800 | 69.8 | 2.3 | 87000 |
| 16 | 46 | 1800 | 14.8 | 2.4 | 12000 |
| 17 | 52 | 1850 | 70.2 | 2.1 | 82000 |
| 18 | 48 | 1850 | 10.3 | 2.1 | 1400 |
| 19 | 38 | 1900 | 10.1 | 2.0 | 61000 |
| 20 | 42 | 1900 | 9.6 | 2.0 | 1500 |

Figure 10:
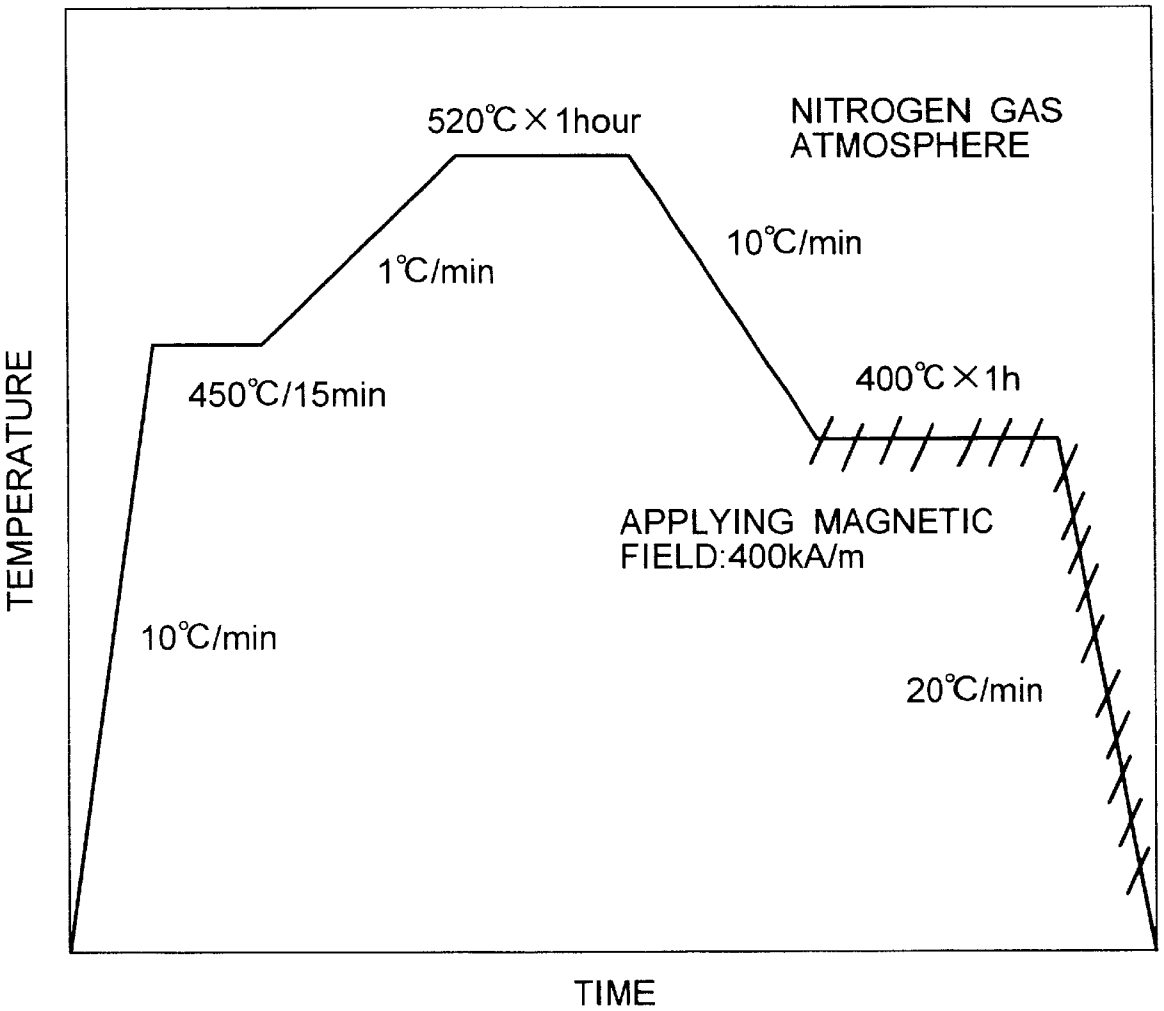
FIG. 10 is a view showing a heat treatment pattern in the invention.

In each of samples Nos. 1 to 10, 16, and 19, the heat treatment shown in FIG. 10 was performed so that nanocrystallized structure was obtained. As a result of the micro structure observation of the heat-treated samples by use of a transmission electron microscope, it was confirmed that the crystal grains of 50 nm or less in average grain size were formed in at least 50% of the structure with respect to the alloy after the heat treatment. On the other hand, in samples Nos. 11, 12, 15, 17, 18, and 20, a heat treatment was performed at a temperature not more than the crystallization temperature thereof. In the alloys after the heat treatment, as a result of X-ray diffraction, such halo pattern as to be peculiar to a amorphous material was observed, so that the amorphous state was confirmed.

The relative magnetic permeability $\mu r$ of each of these samples at a measurement frequency of 1 kHz and at a measurement magnetic field of 0.05 Am-1 was measured. As is apparent from the results in Table 2, it is confirmed that a magnetic core composed of each of the strips with small warpage according to the invention exhibits a high relative magnetic permeability $\mu r$ and that the strips of the invention are superior as the material of the magnetic core.

(Embodiment 5)

Now, Embodiment relating to the air pockets is described below.

By using the same single roll device as that of FIG. 1, an amorphous alloy strip of 50 kg having a width of 15 mm was produced by the steps of preparing a alloy melt consisting, by atomic %, of Si: 15.6 atomic %; B: 6.8 atomic %; Nb: 2.9 atomic %; Cu: 0.9 atomic %; and the balance substantially Fe, and ejecting the melt from a slit of a ceramic nozzle onto the Cu—Be alloy cooling roll of 800 mm in outer diameter. The temperature of the ejected melt was 1300° C., the nozzle slit having dimensions of 15 mm×0.6 mm, a gap between the nozzle tip end and the cooling roll being 80 $\mu$m, and the ejected melt pressure and roll periphery speed were changed when the amorphous alloy strips of 15 mm in width were fabricated.

Next, the structure of the amorphous alloy strips on the roll contact face side was observed by a laser microscope, and the size of each of air pockets occurring on the roll face side of the strips was obtained. The air pockets were in the shape of recess extended in the longitudinal strip direction, and the width W and length L of the largest air pocket existing in field of the naked eyes were measured. Further, the measurement of the centerline average roughness Ra was performed by X-ray diffraction and face roughness meter on the roll face side of the strip.

Then, the obtained strip was placed with its roll contact face side being an outside, and was wound to form a wound magnetic core having an outer diameter of 25 mm and an inner diameter of 20 mm, and a heat treatment in a magnetic field was performed by a pattern shown in FIG. 10. The magnetic field was applied in the direction of the height of the magnetic core. In this case, the squareness was lower than that in a case in which no heat treatment in a magnetic field was performed. As a result of the observation of the structure by use of the transparent electron microscope, it was confirmed that about 70% of the structure of the soft magnetic alloy strip constituting the heat-treated magnetic core contain fine crystal grains of about 12 nm in grain size.

Then, this wound magnetic core was placed in a phenol resin core case, a loop being wound therearound, and the relative initial magnetic permeability $\mu_{iac}$ thereof was measured at a current B—H loop and at 50 Hz.

Figure 6:
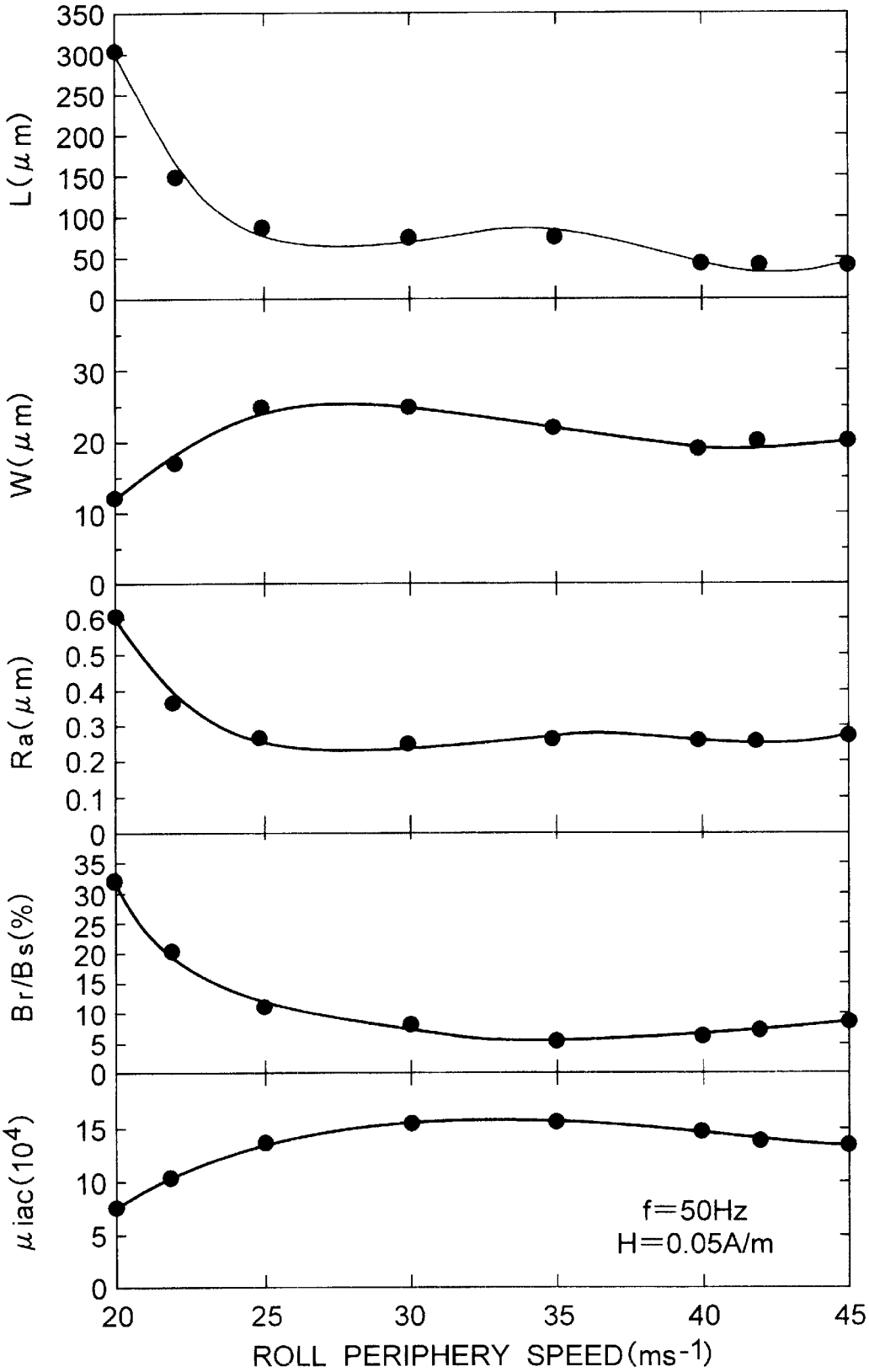
FIG. 6 is a view showing the dependence on roll peripheral speed regarding each of the width W, length L of the maximum air pocket, centerline average roughness Ra, squareness Br/Bs of magnetic core after heat treatment, and relative initial magnetic permeability ($\mu_{iac}$) at 50 Hz.

In FIG. 6, the dependency on roll periphery speed is shown regarding each of the width W of the maximum air pocket on the roll contact face side of the soft magnetic alloy strip, the length L of the maximum air pocket, the centerline average roughness Ra, the squareness of the magnetic core after heat treatment Br/Bs, and the relative initial magnetic permeability $\mu_{iac}$ at 50 Hz. The ejected melt pressure was constantly set to be 350 gf/cm$^2$. In the case where the roll periphery speed was changed, the width W of the maximum air pocket was 35 $\mu$m or less, which is not particularly remarkable. The air pocket length L was 150 $\mu$m or less within the roll periphery speed range of 22 m/s or more. However, in the case where the roll periphery speed was less than 22 m/s, the length L suddenly increased and exceeded the level of 150 $\mu$m. The centerline average roughness Ra of the roll contact face side of the strip was not more than 0.5 $\mu$m in a case where the roll periphery speed was not less than 22 m/s, however, the roughness suddenly increased in another case where the roll periphery speed was less than 22 m/s. In the case of the roll periphery speed of not less than 22 m/s at which the length of the air picket on the roll contact face side of the strip and Ra are small, it becomes possible to obtain such superior characteristics as squareness Br/Bs is 20% or less and as the relative initial magnetic permeability $\mu_{iac}$ at 50 Hz is 100000 or more. On the other hand, in another case where the roll periphery speed is less than 22 m/s, it is found that the L and Ra are large, that the squareness Br/Bs of the magnetic core manufactured by using this strip is hardly lowered, and that the relative initial magnetic permeability $\mu_{iac}$ is lowered.

Figure 7:
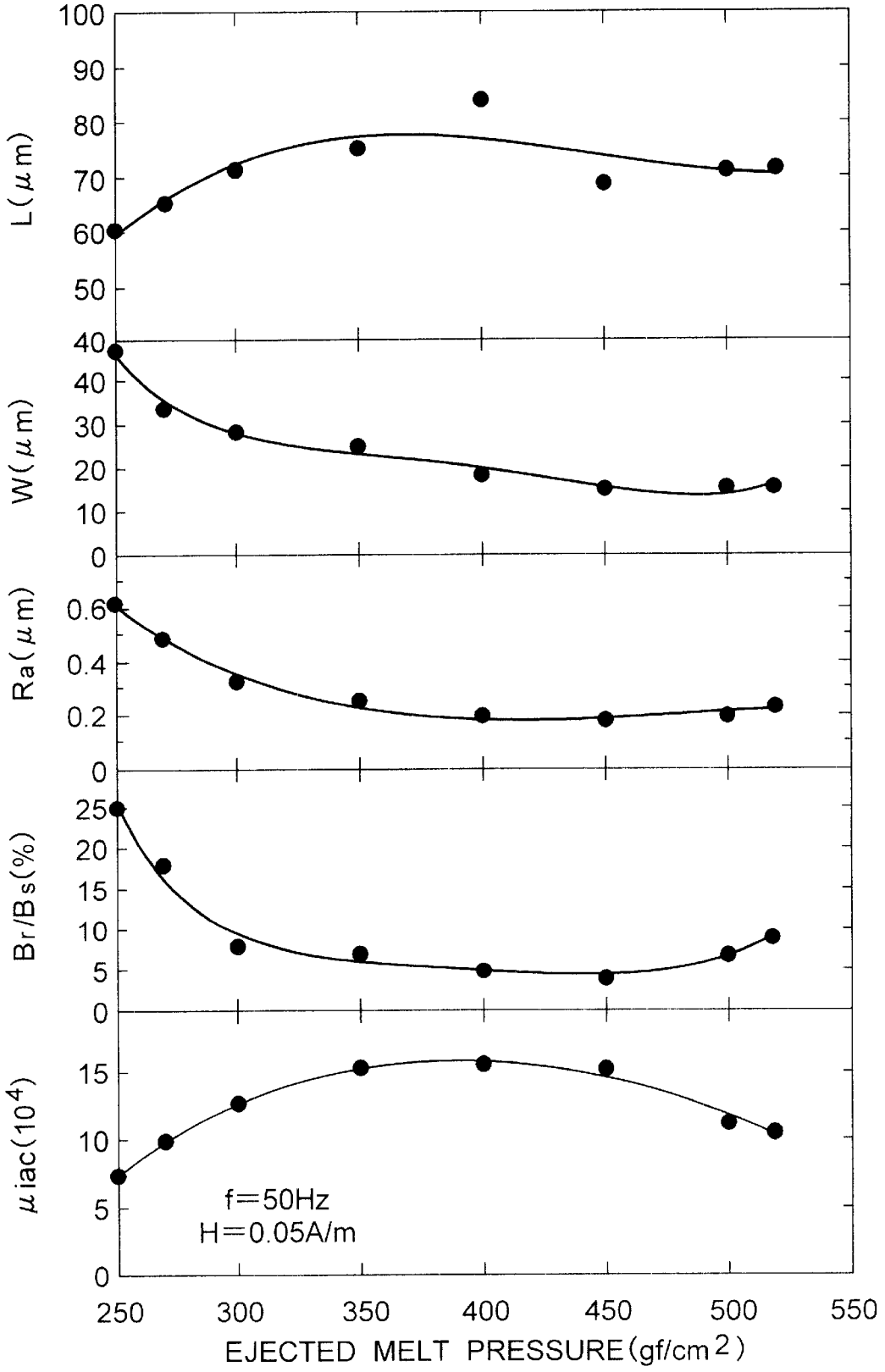
FIG. 7 is a view showing the dependence on a molten alloy-ejecting pressure regarding each of the width W, length L of the maximum air pocket, centerline average roughness Ra, squareness Br/Bs of magnetic core after heat treatment, and relative initial magnetic permeability ($\mu_{iac}$) at 50 Hz.

In FIG. 7, the dependence on the ejected-melt pressure is shown regarding each of the width W of the maximum air pocket on the roll contact face side of the fabricated soft magnetic alloy strip, the length L of the maximum air pocket, the centerline average roughness Ra, the squareness Br/Bs of the magnetic core after heat treatment, and the relative initial magnetic permeability $\mu_{iac}$ at 50 Hz. The roll periphery speed was constantly set to be 30 m/s. In a range where the ejected melt pressure is 270 gf/cm$^2$ or more, there are obtained such superior characteristics as the width of the air pocket occurring on the roll contact face side of the strip is 35 $\mu$m or less, as the centerline average roughness Ra of the roll contact face side thereof is 0.5 $\mu$m or less, as the squareness Br/Bs is 20% or less, and as the relative initial magnetic permeability $\mu_{iac}$ at 50 Hz is 100000 or more. On the other hand, in another range where the ejected melt pressure is less than 270 gf/cm$^2$, it is found that the W and Ra are large, the squareness Br/Bs being hardly lowered with respect to the magnetic characteristics of the magnetic core, and the relative initial magnetic permeability $\mu_{iac}$ is lowered.

From the foregoing, it has found that, by making the ejected melt pressure not less than 270 gf/cm$^2$ while making the speed of the cooling roll periphery not less than 22 m/s, there can be achieved a soft magnetic alloy strip having such properties as the width of the air pocket occurring on the roll contact face side of the strip is not more than 35 $\mu$m, as the air pocket length is not more than 150 $\mu$m, and as the in centerline average roughness Ra of the roll contact face side of the strip is not more than 0.5 $\mu$m, whereby a magnetic core made of this strip which core has superior magnetic characteristics can be achieved. In particular, within the range at which the ejected melt pressure is not less than 350 gf/cm$^2$ but not more than 450 gf/cm$^2$ and at which the periphery speed of the cooling roll is not less than 22 m/s but not more than 40 m/s, it is found that the squareness Br/Bs becomes low, and the particularly high permeability can be obtained, which is preferable.

Figure 8A:
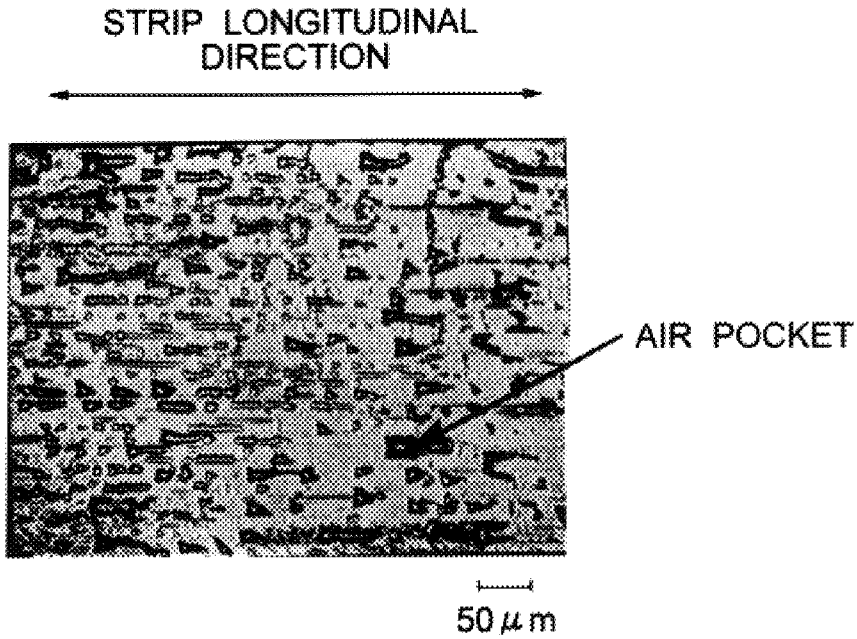
FIG. 8 is a view showing an example of structure of the roll contact face side of the soft magnetic alloy strip of the invention before heat treatment.
Figure 8B:
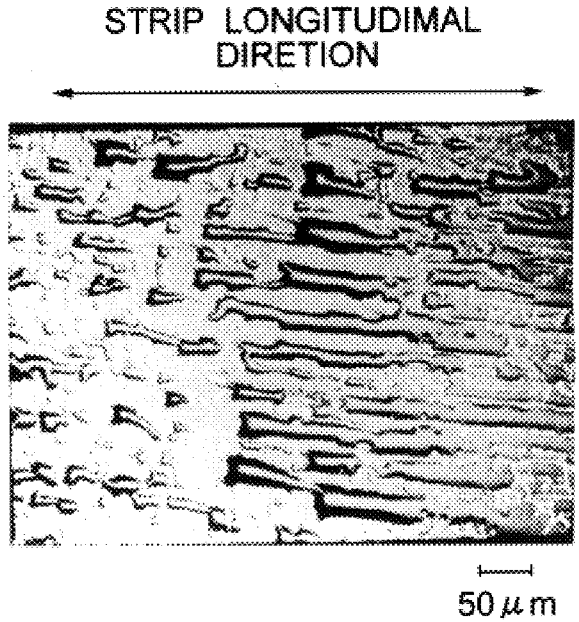

FIGS. 8A and 8B show examples of the structure of the roll contact face side of the fabricated soft magnetic alloy strip before heat treatment. In the soft magnetic alloy strip according to the invention fabricated at the ejected melt pressure of 400 gf/cm$^2$ and at the roll periphery speed of 32 m/s, it is found that the width and length of the air pockets are small, that is, the size of the air pockets is small. On the other hand, in the alloy strip manufactured under such conditions as the ejected melt pressure is 280 gf/cm$^2$ and as roll periphery speed is 20 m/s, both of which are out of the manufacturing conditions of the invention, it is found that many air pockets with long and large size occur.

Figure 9A:
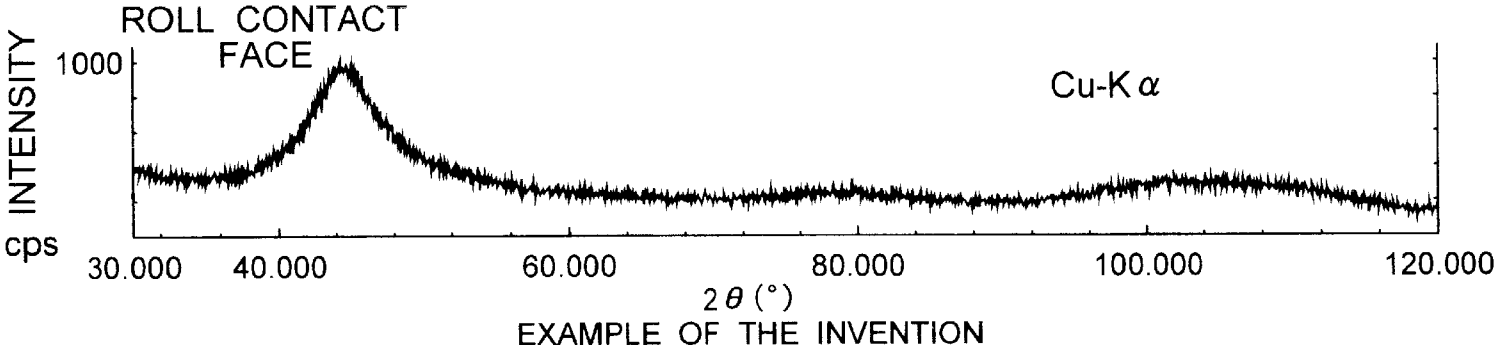
FIG. 9 is a view showing an example of X-ray diffraction patterns on the roll contract face side of the soft magnetic alloy strip according to the invention.
Figure 9B:
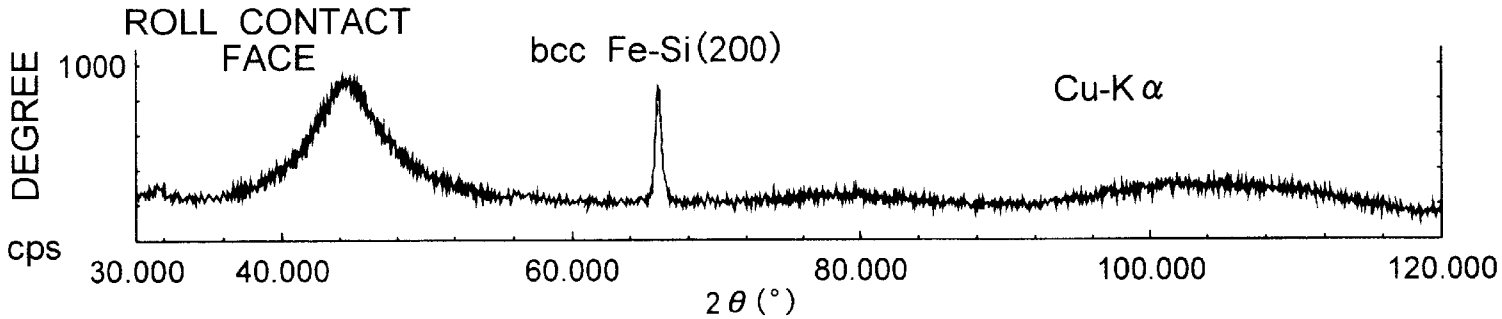

FIGS. 9A and 9B show X-ray diffraction patterns on the roll contact face side of the soft magnetic alloy strip shown in FIG. 6. In the soft magnetic alloy strip of the invention fabricated under the manufacturing conditions of the invention shown above, only a halo pattern is observed, and no crystal peak is observed. On the other hand, in the soft magnetic alloy strip manufactured by the above described manufacturing method other than that of the invention, it is found that a (200) peak of the bcc Fe—Si phase as well as the halo pattern is observed, and that a crystal phase partially exists in the structure. In this case, as a result of sectional plane observation by using a transmission electron microscope, it is confirmed the crystal phase exists at the air pocket portions on the roll face side, and that the grain size thereof is larger than the grain size of crystals occurring after heat treatment. From the facts, one of the reasons why the magnetic characteristics of the magnetic core made of the soft magnetic alloy strip other than that of the invention is inferior is considered to be that, when the size of the air pocket portions is larger than a certain size in comparison with a case where the size of the air pocket portion is small, a cooling rate at the portions which do not come into direct contact with the cooling roll is lowered significantly during the manufacture, so that the surface crystallization is apt to occur during the manufacture of the strip.

(Embodiment 6)

Figure 11:
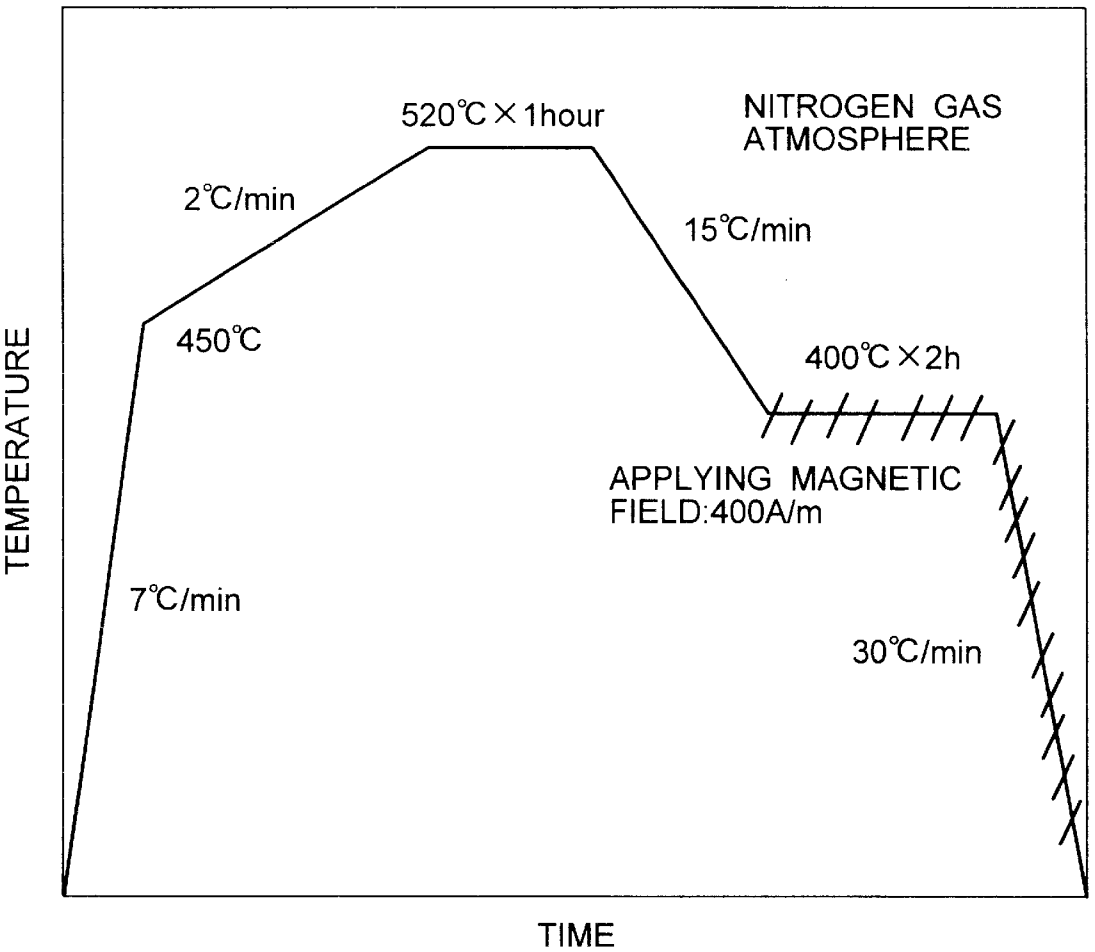
FIG. 11 is a view showing another heat treatment pattern in the invention.

Regarding each of the various compositions shown in Table 3, an amorphous alloy strip of 25 mm in width was fabricated by the single roll method shown in FIG. 1 in accordance with each of a manufacturing method according to the present invention and a manufacturing method other than that of the invention. The method of the invention was performed under ejected melt pressure of 450 gf/cm$^2$ at a roll periphery speed of 32 m/s, and the method other than that of the invention was performed under ejected melt pressure of 350 gf/cm$^2$ at a roll periphery speed of 20 m/s. Regarding each of the manufactured strips, the width W of the maximum air pocket on the roll contact face side of the fabricated soft magnetic alloy strips, air pocket length L, and centerline average roughness Ra were measured. Then, each of the alloy strips was wound to form a toroidal magnetic core having an outer diameter of 50 mm and an inner diameter of 45 mm, which toroidal magnetic core was then heat-treated at a temperature not less than the crystallization temperature by using the heat treatment pattern shown in FIG. 11. At the time of this heat treatment, in order to provide characteristics suitable to uses which requires low squareness, a DC magnetic field of 400 kA/m was applied in the direction perpendicular to the height of the magnetic core during the period shown in FIG. 11. As the result thereof, fine crystal grains of 50 nm or less in grain size were formed in a range of at least 50% of the magnetic core material after the heat treatment. Then, regarding the magnetic core, DC B—H loop and relative initial magnetic permeability $\mu_{iac}$ at 50 Hz were measured. Table 3 shows, regarding the roll contact face side of the soft magnetic alloy strips, the width W of the maximum air pocket, air pocket length L, centerline average roughness Ra, squareness Br/Bs, and relative initial magnetic permeability $\mu_{iac}$ at 50 Hz.

TABLE 3

| No. | Composition (atomic %) | Examples of the invention | | | | | Comparative examples | | | | |
|---|---|---|---|---|---|---|---|---|---|---|---|
| | | W (μm) | L (μm) | Ra (μm) | Br/Bs (%) | $\mu_{iac}$ | W (μm) | L (μm) | Ra (μm) | Br/Bs (%) | $\mu_{iac}$ |
| 1 | $Fe_{bal.}Cu_{0.6}Nb_{2.6}Si_{14}B_9$ | 23 | 60 | 0.24 | 5 | 154000 | 16 | 301 | 0.59 | 30 | 78500 |
| 2 | $Fe_{bal.}Cu_{0.6}Ta_{2.6}Si_{14.5}B_{8.5}$ | 20 | 58 | 0.23 | 6 | 149000 | 23 | 285 | 0.57 | 28 | 77200 |
| 3 | $Fe_{bal.}Cu_{1.0}Mo_{3.6}Si_{14.5}B_9$ | 19 | 57 | 0.21 | 7 | 138000 | 19 | 268 | 0.53 | 23 | 75800 |
| 4 | $(Fe_{0.99}Co_{0.01})_{bal.}Cu_{0.8}Nb_{2.6}Si_{14.5}B_9$ | 21 | 55 | 0.22 | 8 | 116000 | 15 | 259 | 0.55 | 22 | 75500 |
| 5 | $(Fe_{0.99}Ni_{0.01})_{bal.}Cu_{0.9}Nb_{2.6}Si_{14.5}B_9$ | 24 | 62 | 0.23 | 9 | 109500 | 16 | 243 | 0.56 | 22 | 75100 |
| 6 | $Fe_{bal.}Cu_{1.1}Nb_{2.5}W_{0.5}Si_{14.5}B_9$ | 23 | 58 | 0.26 | 8 | 119000 | 17 | 261 | 0.57 | 25 | 79600 |
| 7 | $Fe_{bal.}Cu_{1.0}Nb_{2.7}V_{0.7}Si_{15.5}B_{7.5}P_1$ | 22 | 52 | 0.31 | 7 | 127500 | 18 | 275 | 0.54 | 27 | 78700 |
| 8 | $Fe_{bal.}Cu_{1.2}Nb_{2.8}Hf_{0.5}Si_{15.5}B_{7.5}C_{0.1}$ | 24 | 61 | 0.28 | 8 | 135600 | 20 | 233 | 0.55 | 28 | 81000 |
| 9 | $Fe_{bal.}Cu_{1.3}Nb_{3.1}Zr_{0.5}Si_{15.5}B_{7.5}Ge_{0.1}$ | 18 | 62 | 0.30 | 7 | 127800 | 24 | 220 | 0.56 | 29 | 80500 |
| 10 | $Fe_{bal.}Cu_{0.8}Nb_{2.9}Ti_{0.5}Si_{15.5}B_{7.5}Ga_{0.1}$ | 16 | 55 | 0.32 | 9 | 119500 | 23 | 235 | 0.53 | 30 | 79500 |
| 11 | $Fe_{bal.}Cu_{1.5}Nb_{2.9}Si_{15.5}B_{7.8}Al_3$ | 15 | 54 | 0.29 | 8 | 122200 | 24 | 241 | 0.54 | 29 | 76300 |
| 12 | $Fe_{bal.}Cu_{11.26}Nb_{2.9}Si_{15.5}B_{7.8}Cr_2N_{0.01}$ | 19 | 50 | 0.25 | 10 | 117900 | 19 | 233 | 0.55 | 28 | 77200 |
| 13 | $Fe_{bal.}Cu_{1.6}Nb_{2.9}Si_{15.5}B_{7.8}Mn_1$ | 18 | 49 | 0.26 | 6 | 135600 | 18 | 229 | 0.56 | 27 | 79000 |
| 14 | $Fe_{bal.}Cu_{1.0}Nb_{2.9}Si_{15.5}B_{7.8}Pd_{0.3}Ca_{0.3}$ | 20 | 59 | 0.18 | 7 | 126800 | 21 | 236 | 0.57 | 26 | 81200 |
| 15 | $Fe_{bal.}Cu_{0.6}Nb_{2.9}Si_{15.5}B_{7.8}Sn_{0.1}$ | 21 | 62 | 0.25 | 9 | 132000 | 23 | 237 | 0.58 | 25 | 82200 |
| 16 | $Fe_{bal.}Au_{0.6}Nb_{2.9}Si_{15.5}B_{7.8}Zn_{0.1}Be_{0.1}$ | 23 | 61 | 0.24 | 8 | 116900 | 24 | 235 | 0.55 | 26 | 79500 |
| 17 | $Fe_{bal.}Au_{0.6}Nb_{2.9}Si_{15.5}B_{7.8}In_{0.1}Ru_{0.3}$ | 22 | 58 | 0.23 | 7 | 121000 | 23 | 248 | 0.54 | 27 | 77700 |
| 18 | $Fe_{bal.}Au_{0.6}Nb_{2.9}Si_{15.5}B_{7.8}Y_{0.01}$ | 20 | 57 | 0.22 | 6 | 119600 | 25 | 251 | 0.53 | 25 | 75200 |

In the alloy strips manufactured by using the manufacturing method of the invention, the length or Ra of the air pocket on the roll contact face side thereof is small; the magnetic core of the invention made of this strip is small in squareness Br/Bs; and the relative initial magnetic permeability $\mu_{iac}$ of this core is high and superior. On the other hand, in the alloy strip manufactured by the manufacturing method other than that of the invention, the air pocket size or Ra on the roll contact face side is large; the magnetic core made of this strip is not sufficiently small in squareness Br/Bs; the relative initial magnetic permeability $\mu_{iac}$ thereof is not sufficiently low; and it is confirmed that, in the magnetic core of the invention, high magnetic permeability and low squareness can be obtained, which means that the magnetic core of the invention is superior.

(Embodiment 7)

Figure 12:
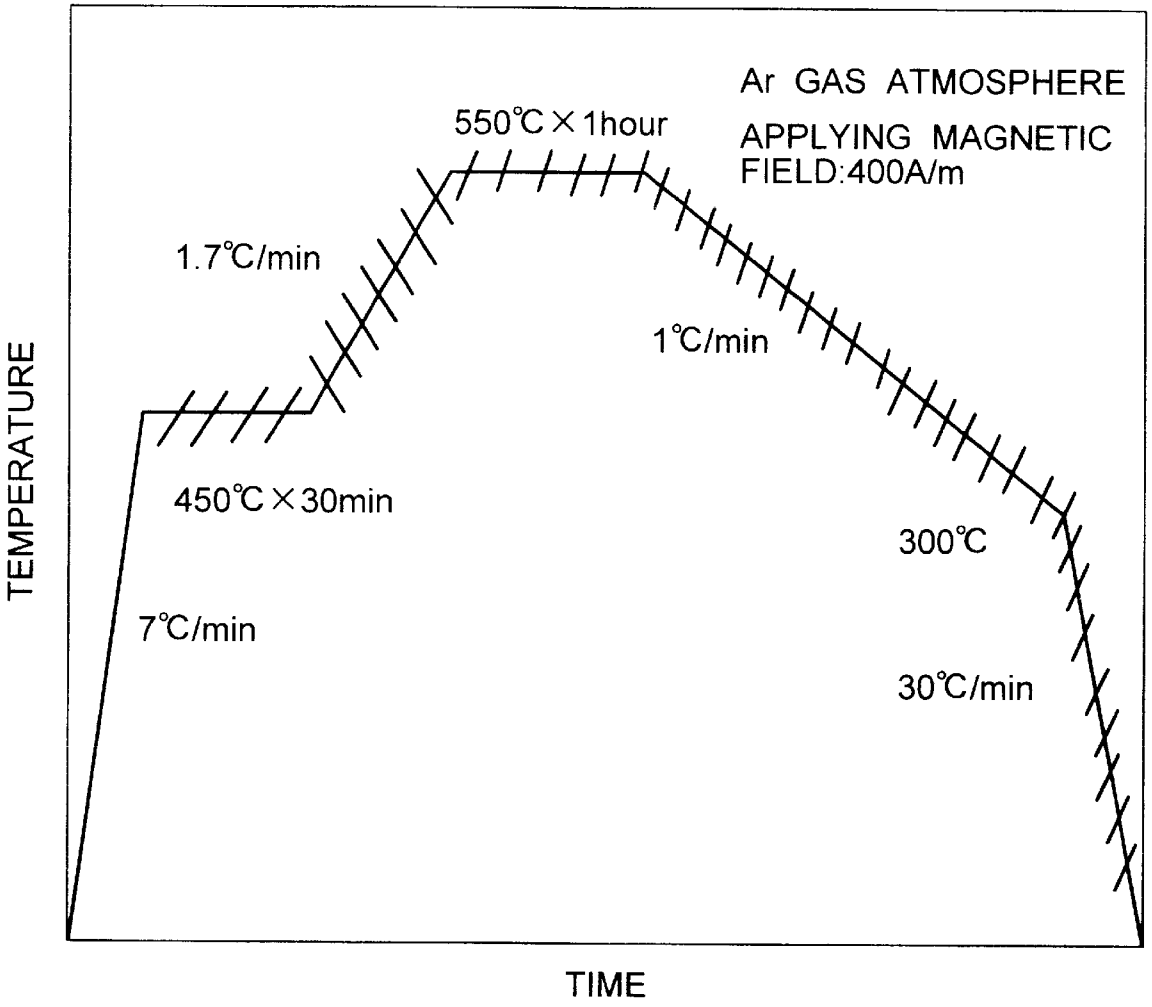
FIG. 12 is a view showing a still another heat treatment pattern in the invention.

Amorphous alloy strips having various compositions shown in Table 4 were fabricated by the single roll method shown in FIG. 1 in accordance with each of a manufacturing method of the invention and a manufacturing method other than that of the invention. The method of the invention was performed under an ejected melt pressure of 450 gf/cm$^2$ at a cooling roll periphery speed of 32 m/s. The method other than that of the invention was performed under an ejected melt pressure of 250 gf/cm$^2$ at a cooling roll periphery speed of 35 m/s. Regarding each of resultant alloy strips, the width W of the maximum air pocket on the roll contact face side of the fabricated soft magnetic alloy strip, air pocket length L, and centerline average roughness Ra were measured. Next, each of the alloy strips was wound to produce a toroidal magnetic core having an outer diameter of 50 mm and inner diameter of 45 mm, which toroidal magnetic core was then heat-treated at a temperature not less than the crystallization temperature in compliance with the pattern shown in FIG. 12. During the heat treatment, in order to provide characteristics suitable to uses such as saturable reactor which requires high squareness, an AC magnetic field whose maximum values were 400 A/m at 50 Hz was applied in the magnetic path direction of the magnetic core during a period shown in FIG. 12. In at least a part of the heat-treated magnetic core material, fine crystal grains of 50 nm or less in grain size were formed. Next, regarding this magnetic core, the DC B—H loop and the magnetic core loss Pcv per a unit volume at a frequency of 100 kHz and at a wave height value of 0.2 T of the magnetic flux density were measured. Table 4 shows, regarding the roll contact face side of the fabricated soft magnetic alloy strip, the width W of the maximum air pocket, air pocket length L, centerline average roughness Ra, squareness Br/Bs, and magnetic core loss PCV per a unit volume at a frequency of 100 kHz at the wave height value 0.2 T of the magnetic flux density.

TABLE 4

| No. | Composition (atomic %) | Examples of the invention | | | | | Comparative examples | | | | |
|---|---|---|---|---|---|---|---|---|---|---|---|
| | | W (μm) | L (μm) | Ra (μm) | Br/Bs (%) | Pcv (kWm$^{-3}$) | W (μm) | L (μm) | Ra (μm) | Br/Bs (%) | Pcv (kWm$^{-3}$) |
| 1 | $Fe_{bal.}Cu_{1.1}Nb_{2.7}Si_{15}B_8$ | 19 | 68 | 0.20 | 96 | 750 | 46 | 58 | 0.59 | 87 | 770 |
| 2 | $Fe_{bal.}Cu_{1.0}Ta_{3.0}Hf_{3.5}B_8$ | 20 | 57 | 0.25 | 94 | 780 | 45 | 57 | 0.58 | 86 | 790 |
| 3 | $Fe_{bal.}Cu_{1.2}Mo_{3.5}Si_{15.8}B_{10}$ | 23 | 55 | 0.23 | 95 | 740 | 39 | 56 | 0.57 | 85 | 740 |
| 4 | $(Fe_{0.99}Co_{0.01})_{bal.}Cu_{0.7}Nb_{2.6}Si_{14.5}B_9$ | 20 | 56 | 0.24 | 94 | 730 | 41 | 57 | 0.59 | 86 | 760 |
| 5 | $(Fe_{0.99}Ni_{0.01})_{bal.}Cu_{1.0}Nb_{2.0}Si_{14.5}B_{9.5}$ | 18 | 58 | 0.20 | 95 | 750 | 42 | 58 | 0.58 | 87 | 750 |
| 6 | $Fe_{bal.}Cu_{0.8}Nb_{2.5}W_{0.5}Si_{13.5}B_{10}$ | 17 | 59 | 0.19 | 97 | 780 | 43 | 59 | 0.57 | 88 | 790 |
| 7 | $Fe_{bal.}Cu_{1.1}Nb_{2.6}V_{0.7}Si_{14.0}B_{7.5}P_2$ | 20 | 60 | 0.25 | 93 | 750 | 42 | 58 | 0.58 | 87 | 750 |
| 8 | $Fe_{bal.}Cu_{0.8}Nb_{2.5}Hf_{0.5}Si_{14.5}B_{7.7}C_{0.1}$ | 22 | 59 | 0.27 | 93 | 730 | 41 | 60 | 0.57 | 86 | 740 |
| 9 | $Fe_{bal.}Cu_{1.0}Nb_{3.1}Zr_{0.5}Si_{14.0}B_{7.5}Ge_1$ | 24 | 58 | 0.22 | 94 | 740 | 44 | 57 | 0.55 | 87 | 750 |
| 10 | $Fe_{bal.}Cu_1Zr_{3.5}Nb_{3.5}B_8Ga_{0.1}$ | 17 | 60 | 0.20 | 95 | 750 | 43 | 61 | 0.56 | 86 | 760 |
| 11 | $Fe_{bal.}Cu_{0.8}Nb_{2.5}Si_{13.5}B_{8.1}Al_3$ | 18 | 61 | 0.18 | 96 | 770 | 39 | 62 | 0.58 | 88 | 780 |

TABLE 4-continued

| No. | Composition (atomic %) | Examples of the invention | | | | | Comparative examples | | | | |
|---|---|---|---|---|---|---|---|---|---|---|---|
| | | W (μm) | L (μm) | Ra (μm) | Br/Bs (%) | Pcv ($kWm^{-3}$) | W (μm) | L (μm) | Ra (μm) | Br/Bs (%) | Pcv ($kWm^{-3}$) |
| 12 | $Fe_{bal.}Cu_{1.0}Nb_{2.5}Si_{14.5}B_{8.1}Cr_2N_{0.01}$ | 19 | 62 | 0.22 | 95 | 750 | 38 | 55 | 0.59 | 87 | 760 |
| 13 | $Fe_{bal.}Cu_{0.6}Nb_{2.8}Si_{14.5}B_{7.8}Mn_{1.5}$ | 20 | 58 | 0.24 | 93 | 740 | 41 | 56 | 0.55 | 86 | 750 |
| 14 | $Fe_{bal.}Cu_{1.0}Nb_{2.5}Si_{15.5}B_{7.8}Pd_{0.3}Ca_{0.3}$ | 21 | 55 | 0.23 | 94 | 790 | 42 | 57 | 0.59 | 85 | 800 |
| 15 | $Fe_{bal.}Cu_{1.1}Nb_{2.5}Si_{15.5}B_{7.8}Sn_{0.1}$ | 22 | 54 | 0.22 | 95 | 780 | 43 | 56 | 0.58 | 86 | 780 |
| 16 | $Fe_{bal.}Au_{0.6}Nb_4Si_{15.5}B_{7.5}Zn_{0.1}Be_{0.1}$ | 18 | 53 | 0.21 | 96 | 790 | 44 | 58 | 0.57 | 87 | 800 |
| 17 | $Fe_{bal.}Au_{0.6}Nb_{2.5}Si_{15.5}B_{7.5}In_{0.1}Ru_{0.3}$ | 17 | 58 | 0.20 | 96 | 780 | 42 | 59 | 0.59 | 86 | 790 |
| 18 | $Fe_{bal.}Au_{0.6}Nb_{2.9}Si_{15.5}B_{7.0}Y_{0.01}$ | 19 | 60 | 0.21 | 96 | 780 | 41 | 60 | 0.57 | 86 | 790 |

In the alloy strip manufactured by the manufacturing method of the invention, the width and Ra of the air pockets on the roll contact face side are small, and the magnetic core of the invention made of this strip is high in squareness Br/Bs and superior. On the other hand, in the alloy strip manufactured by the manufacturing method other than that of the invention, the air pocket size and Ra of the roll contact face side is large, and the magnetic core made of this strip is not sufficiently high in squareness Br/Bs. It is confirmed that in the invention, the magnetic core is high in squareness and superior for a magnetic switch and magnetic core for saturable reactor.

(Embodiment 8)

An amorphous alloy strip of 15 mm in width and about 18 μm in thickness having each of the various compositions shown in Table 5 was fabricated by the single roll method shown in FIG. 1 according to the manufacturing method of the invention and a manufacturing method other than that of the present invention. The method of the invention was performed under an ejected melt pressure of 450 gf/cm$^2$ at a cooling roll periphery speed of 33 m/s, and the method other than the method of the invention was performed under an ejected melt pressure of 450 gf/cm$^2$ at a cooling roll periphery speed of 20 m/s. Regarding each of resultant alloy strips, the surface roughness Rz of the alloy strip on the side opposite to the roll contact side thereof (free face side) and an average strip thickness calculated from the weight of the alloy strip was measured to thereby get a value of parameter Rf=Rz/T. On the other hand, the width W and length L of the air pockets occurring on the face (the roll contact face side) in contact with the cooling roll, and centerline average roughness Ra of the face in contact with the roll were measured. Further, in order to study whether or not crystallized grains occurred at an air pocket portion on the roll face side during the manufacture, X-ray diffraction on the roll face side was performed. As a result, as shown in Table 5, in the alloy strip of the invention, although only the halo pattern was observed, and no crystal peak was observed, however, in the alloy strip fabricated by the manufacturing method other than that of the invention, a crystal peak considered to be the bcc Fe—Si phase was partly observed.

Next, each of the alloy strips was wound to form a magnetic core having an outer diameter of 25 mm and an inner diameter of 20 mm. Then, the magnetic core was heat-treated at a temperature not less than the crystallization temperature in the pattern shown in FIG. 11. During the heat treatment, a DC magnetic field of 400 kA/m was applied in the direction of the height of the magnetic core. Then, the relative initial magnetic permeability $\mu_{iac}$ at 50 Hz of each of the samples after the heat treatment was measured. In each of the alloy strips after the heat treatment, as a result of observation using a transmission electron microscope, it was confirmed that 50% or more of the structure includes fine crystal grains of 50 nm or less in grain size. Regarding the manufactured soft magnetic alloy strips, Table 5 shows area occupying rate of recesses occurring in the strip, Rf=Rz/T on the free face side, the width W and length L of the air pocket on the cooling roll contact face side, centerline average roughness Ra, the existence or non-existence of crystal peaks measured by using X-ray diffraction on the roll contact face side, and $\mu_{iac}$ after heat treatment.

TABLE 5

| | No. | Composition (at %) | Recess occupying rate (%) | Surface roughness of the free face Rf | Width of the air pocket of the roll contact face W (μm) | Length of the air pocket of the roll contact face L (μm) | Centerline average roughness of the roll contact face side Ra | Existence or non-existence of crystal peak on roll contact face side immediately after the strip manufacture | $\mu_{iac}$ |
|---|---|---|---|---|---|---|---|---|---|
| Example of the invention | 1 | $Fe_{73}Cu_1Nb_3Si_{15}B_8$ | 22 | 0.23 | 23 | 60 | 0.23 | non-existence | 143000 |
| | 2 | $Fe_{72.5}Cu_1Nb_3Si_{15}B_{8.5}$ | 32 | 0.27 | 19 | 57 | 0.21 | " | 158000 |
| | 3 | $Fe_{73}Cu_1Mo_3Si_{15}B_8$ | 28 | 0.32 | 23 | 58 | 0.22 | " | 139000 |
| | 4 | $Fe_{72.5}Cu_1Mo_3Si_{15}B_{8.5}$ | 33 | 0.27 | 24 | 61 | 0.23 | " | 142000 |
| | 5 | $Fe_{76.8}Cu_{0.6}Nb_{2.6}Si_{11}B_9$ | 18 | 0.22 | 26 | 63 | 0.31 | " | 129000 |
| | 6 | $Fe_{75.8}Cu_{0.6}Nb_{2.6}Si_{12}B_9$ | 34 | 0.33 | 24 | 55 | 0.29 | " | 139500 |
| | 7 | $Fe_{73.1}Cu_{0.9}Nb_2Mo_1Si_{14}B_9$ | 28 | 0.31 | 25 | 56 | 0.26 | " | 122600 |
| | 8 | $Fe_{73}Cu_{0.9}Nb_2Mo_1Si_{14}B_{9.1}$ | 31 | 0.30 | 27 | 52 | 0.18 | " | 123000 |
| | 9 | $Fe_{84}Cu_1Nb_{3.5}Zr_{3.5}B_8$ | 20 | 0.24 | 22 | 54 | 0.22 | " | 118000 |
| | 10 | $Fe_{83.5}Cu_1Nb_{3.5}Zr_{3.5}B_{8.5}$ | 31 | 0.30 | 24 | 53 | 0.21 | " | 108000 |
| Comparative Example | 1 | $Fe_{73}Cu_1Nb_3Si_{15}B_8$ | 22 | 0.24 | 17 | 305 | 0.59 | existence | 77500 |
| | 2 | $Fe_{72.5}Cu_1Nb_3Si_{15}B_{8.5}$ | 32 | 0.26 | 37 | 140 | 0.53 | " | 81000 |

TABLE 5-continued

| No. | Composition (at %) | Recess occupying rate (%) | Surface roughness of the free face Rf | Width of the air pocket of the roll contact face W ($\mu$m) | Length of the air pocket of the roll contact face L ($\mu$m) | Centerline average roughness of the roll contact face side Ra | Existence or non-existence of crystal peak on roll contact face side immediately after the strip manufacture | $\mu_{iac}$ |
|---|---|---|---|---|---|---|---|---|
| 3 | $Fe_{73}Cu_1Mo_3Si_{15}B_8$ | 28 | 0.33 | 24 | 220 | 0.56 | " | 78700 |
| 4 | $Fe_{72.5}Cu_1Mo_3Si_{15}B_{8.5}$ | 33 | 0.26 | 25 | 210 | 0.55 | " | 80500 |
| 5 | $Fe_{76.8}Cu_{0.6}Nb_{2.6}Si_{11}B_9$ | 18 | 0.23 | 23 | 268 | 0.53 | " | 79500 |
| 6 | $Fe_{75.8}Cu_{0.6}Nb_{2.6}Si_{12}B_9$ | 34 | 0.34 | 21 | 236 | 0.57 | " | 76000 |
| 7 | $Fe_{73.1}Cu_{0.9}Nb_2Mo_1Si_{14}B_9$ | 28 | 0.30 | 23 | 248 | 0.54 | " | 81000 |
| 8 | $Fe_{73}Cu_{0.9}Nb_2Mo_1Si_{14}B_{9.1}$ | 31 | 0.31 | 38 | 310 | 0.59 | " | 76500 |
| 9 | $Fe_{84}Cu_1Nb_{3.5}Zr_{3.5}B_8$ | 20 | 0.23 | 25 | 251 | 0.53 | " | 75100 |
| 10 | $Fe_{83.5}Cu_1Nb_{3.5}Zr_{3.5}B_{8.5}$ | 31 | 0.30 | 18 | 229 | 0.56 | " | 74100 |

As regards the values of Rf on the free face side, there is no substantial difference between one within the scope of the present invention and one outside of the invention. However, insofar as alloy strips which had such width W and length L of the air pocket on the roll contact side and such centerline average roughness Ra as to be in the scope of the invention, no crystal peak was observed in X-ray diffraction pattern on the strip roll contact face side immediately after the manufacture. On the other hand, in a case where they were out of the scope of the invention, it is found that a crystal peak was observed, and $\mu_{iac}$ was lowered. From the foregoing, even if the area occupying rate of the recess portion of the strip and/or Rf is small, it is found that $\mu_{iac}$ is unfavorably lowered in the case where they (the area occupying rate and Rf) are out of the scope of the present invention. When the width W, length L, and Ra of the air pockets are out of the scope of the invention, it is considered that coarse crystal grains easily occur at air pocket portions with the result that lowering of $\mu_{iac}$ is caused.

(Embodiment 9)

Figure 13:
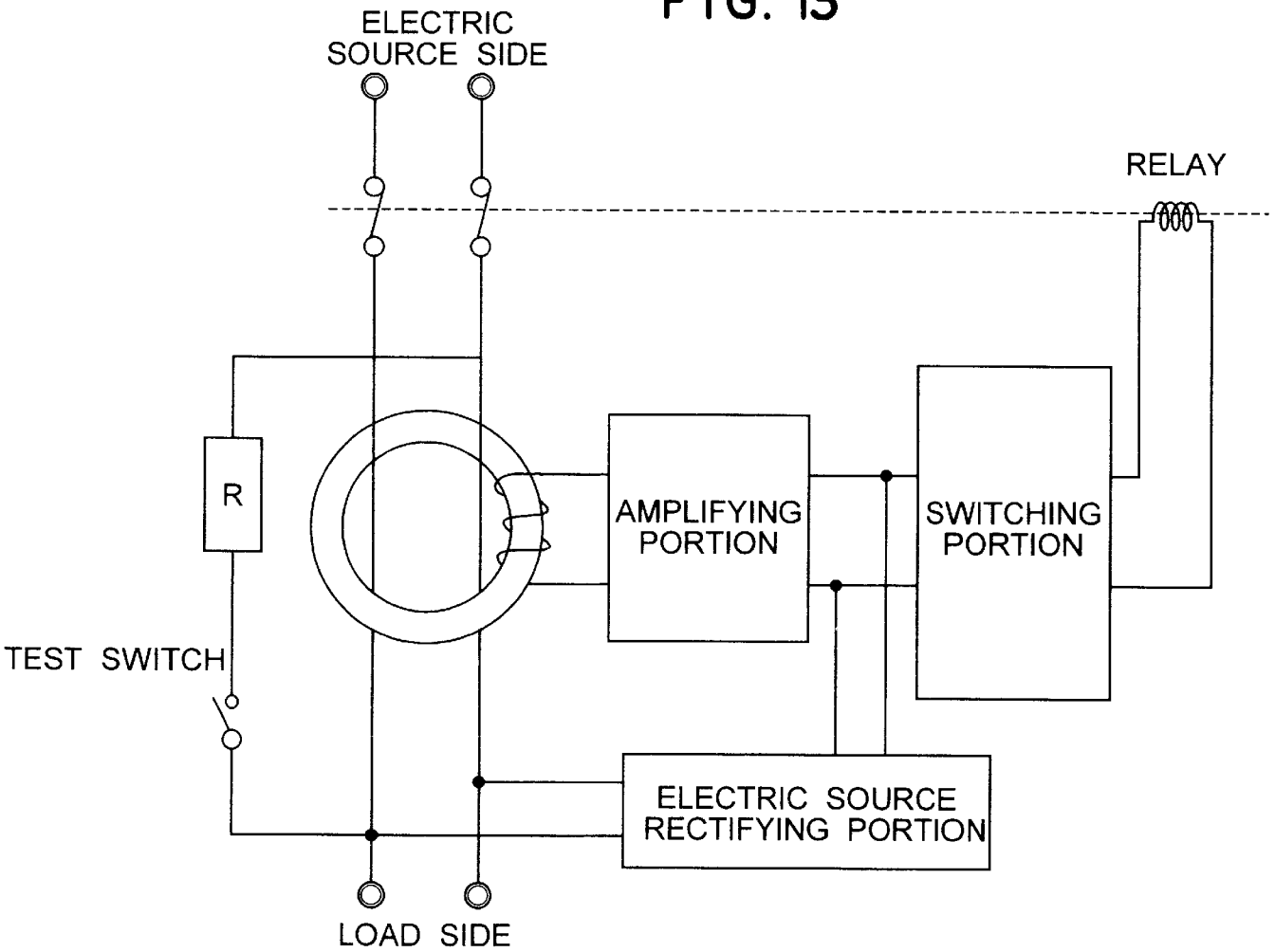
FIG. 13 is a view showing an example of a circuit of a leakage breaker related to the invention.

Now, an amorphous alloy strip of 25 mm in width and 18 $\mu$m in thickness consisting, by atomic %, of Cu: 1.1%; Nb: 2.3%; Mo: 0.7%; Si: 15.7%; B: 7.1%; and the balance substantially Fe was fabricated by using the single roll method according to the invention for restricting the warpage and air pocket. The ejected melt temperature was set to be 1300° C., a gap between the nozzle tip end and the cooling roll being 100 $\mu$m, the ejected melt pressure being 400 gf/cm$^2$, the roll periphery speed being 32 m/s, the cooling roll surface temperature being 200° C., and the peeling-off distance was set to be 650 mm. The warpage of the manufactured magnetic alloy strip of the invention was 0.9 mm. After providing slits each having a width of 10 mm in the alloy strip, a toroidal magnetic core was formed by winding the strip and was subjected to heat treatment similar to that shown in FIG. 10 so that at least 50% of the structure of the magnetic core contained nano-crystal grains of 50 nm or less, and a leakage alarm shown in FIG. 13 was produced by using the core. For the purpose of comparison, an amorphous alloy strip of the same composition was manufactured under an ejected melt pressure of 250 gf/cm$^2$, at a roll periphery speed of 20 m/s, at a cooling roll surface temperature of 180° C, and in a peeling-off distance of 1800 mm. Then, a magnetic core other than that of the present invention was fabricated in a similar process by use of the comparison strip. Table 6 shows the width W of the maximum air pocket on the roll contact face side of the soft magnetic alloy strip, air pocket length L, and centerline average roughness Ra regarding each of the strip of the invention and the comparative strip.

TABLE 6

| | W ($\mu$m) | L ($\mu$m) | Ra ($\mu$m) |
|---|---|---|---|
| Example of the invention | 20 | 59 | 0.22 |
| Comparative example | 24 | 290 | 0.59 |

In the soft magnetic alloy strip of the present invention, the air pocket length L and the centerline average roughness Ra are small. On the other hand, in the strip of Comparative Example, the strip often broke in the manufacturing process, and no long strip of 50 m or more was obtained. Further, testing for a leakage current was performed by use of leakage alarms formed of these strips, it was confirmed that the leakage alarm of the invention was able to be operated at a current level smaller than by 30% than that of a compared leakage alarm, and was remarkably sensitive.

(Embodiment 10)

Figure 14:
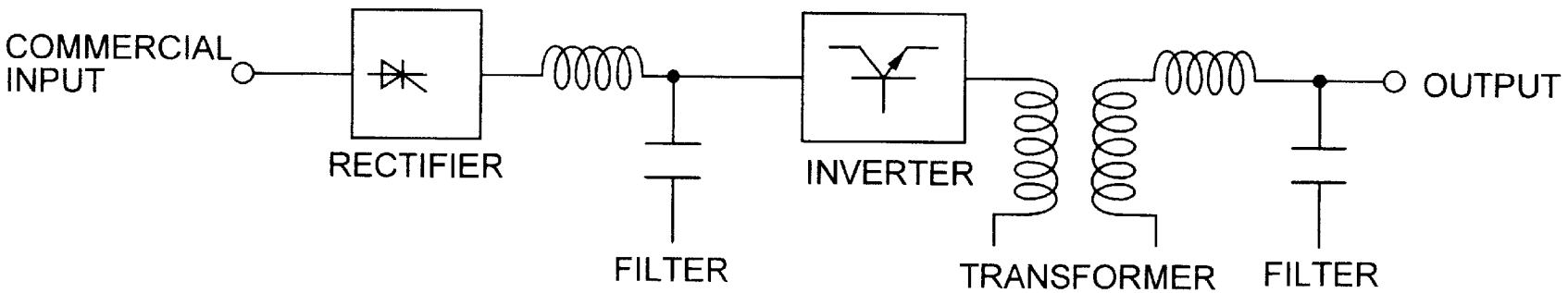
FIG. 14 is a view showing an example of an inverter circuit relating to the invention.

An amorphous alloy strip having a width of 30 mm and a thickness of 17 $\mu$m which consists, by atomic % of Cu: 0.8%; Nb: 2.8%; W: 0.2 atomic %; Si: 13.5 atomic %; B: 8 atomic %; and the balance substantially Fe was fabricated by the single roll method for restricting the warpage and air pocket according to the invention. In the method, the temperature of the ejected melt was set to be 1300° C., a gap between the nozzle tip end and the cooling roll being 100 $\mu$m, the ejected melt pressure being 400 gf/cm$^2$, the roll periphery speed being 32 m/s, the cooling roll surface temperature being 190° C., and the peeling-off distance was set to be 600 mm. The warpage of the manufactured soft magnetic alloy strip according to the invention was 1.1 mm. Slits each having a width of 25 were provided in this strip, and was wound to make a toroidal magnetic core, which was then subjected to the same heat treatment as that shown in FIG. 10, and the magnetic core of the invention having the structure of nano-crystal grains was fabricated, and it was mounted in a transformer of an inverter circuit having the constitution shown in FIG. 14. For comparison, another amorphous alloy strip of the same composition was produced under the ejected melt pressure of 200 gf/cm$^2$, at the roll periphery speed of 30 m/s, at the cooling roll surface temperature of 180° C., and the peeling-off distance of 1800 mm. A magnetic core was produced in the same step as above. By using this magnetic core, another inverter transformer was fabricated, and it was mounted in the circuit shown in FIG. 14. Table 7 shows the width W of the maximum air pocket on the roll contact face side of the soft magnetic alloy strip, air pocket length L, centerline average roughness Ra, and transformer volume ratio regarding each of the soft magnetic alloy strips of the invention and of the comparative example.

TABLE 7

| | W (μm) | L (μm) | Ra (μm) | Volume ratio |
|---|---|---|---|---|
| Example of the invention | 19 | 58 | 0.20 | 0.85 |
| Comparative example | 41 | 67 | 0.61 | 1 |

In the soft magnetic alloy strip of the invention, the air pocket length L and centerline average roughness Ra are small. In the strip of Comparative Example, the strip often broke in the manufacturing process, and no long strip of 50 m or more was obtained.

In Table 7, the transformer volume ratio of the Comparative example was defined as 1. It is confirmed that the volume of the transformer according to the invention can be reduced by 15% in comparison with that of the comparative example and that it is superior.

What is claimed is:

1. A soft magnetic alloy strip having a width dmm manufactured by a single roll method, wherein said strip width d is not less than 10 mm, and warpage occurring in a widthwise direction of the strip is not more than 0.2×dmm.

2. A soft magnetic alloy strip manufactured by a single roll method, wherein a width of an air pocket occurring on a roll contact face of said strip is not more than 35 μm, an air pocket length being not more than 150 μm, and a centerline average roughness Ra of the roll contact face of said strip is not more than 0.5 μm.

3. A soft magnetic alloy strip according to claim 1, wherein strip thickness is not more than 25 μm.

4. A soft magnetic alloy strip according to claim 1, wherein strip thickness is not more than 20 μm and strip width d is not less than 20 mm.

5. A soft magnetic alloy strip according to any one of claims 1, 3, and 4, wherein said strip has a continuous length not less than 50 m in longitudinal direction of the strip.

6. A soft magnetic alloy strip produced by the steps of:

ejecting an alloy melt from a nozzle having a slit onto a rotating metallic cooling roll;

keeping the cooling roll at a temperature of not less than 80° C. but not more than 300° C. after the lapse of 5 seconds or more following the ejecting of said melt; and peeling solidified alloy off the cooling roll within a distance of 100 mm to 1500 mm measured along circumference of said roll from a position immediately beneath said nozzle slit to thereby provide the strip having a thickness not more than 30 μm, a width d not less than 10 mm, warpage not more than 0.2×d mm in widthwise direction of the strip, and a continuous length not less than 50 m in longitudinal direction of said strip.

7. A soft magnetic alloy strip produced by the steps of:

ejecting alloy melt from a nozzle having a slit onto a rotating metallic cooling roll;

providing a gap not less than 20 μm but not more than 200 μm between said cooling roll and said nozzle tip end during the ejecting of the alloy melt while keeping pressure of said ejected melt not less than 270 gf/cm$^2$ during the ejecting of the alloy melt and periphery speed of said cooling roll not less than 22 m/s so that a width not more than 35 μm regarding air pockets occurring on a roll contact face of said strip, an air pocket length not more than 150 μm or less and centerline average roughness Ra of the roll contact face of said strip of not more than 0.5 μm are provided in the strip.

8. A soft magnetic alloy strip produced by the steps of:

ejecting an alloy melt from a nozzle having a slit onto a rotating metallic cooling roll;

keeping a cooling roll surface at a temperature of not less than 80° C. but not more than 300° C. after the lapse of 5 seconds or more following the ejecting of said melt;

providing a gap not less than 20 μm but not more than 200 μm between said cooling roll and said nozzle tip end, an ejected melt pressure not less than 270 gf/cm$^2$ during the ejecting of said melt, and a cooling roll periphery speed not less than 22 m/s; and peeling solidified alloy off the cooling roll at a location within the range of 100 mm to 1500 mm measured from a roll position immediately beneath said nozzle slit along a roll circumference so that the strip is provided with a thickness not more than 30 μm, a width d not less than 10 mm, and warpage not more than 0.2×d mm in widthwise direction of the strip, wherein a width of air pockets occurring on a roll contact face of said strip is not more than 35 μm, a length of said air pockets being not more than 150 μm, a centerline average roughness Ra of the roll contact face of said strip being not more than 0.5 μm, and said strip has a continuous length not less than 50 m in longitudinal direction of said strip.

9. A soft magnetic alloy strip according to any one of claims 1 to 4, and 6 to 8, wherein said soft magnetic alloy strip is represented by composition formula of $Fe_{100-x-a-y-z}A_x M_a Si_y B_z$ (atomic %) wherein A is at least one element selected from the group consisting of Cu and Au; M being at least one element selected from the group consisting of Ti, Zr, Hf, Mo, Nb, Ta, W, and V; x, y, z and "a" satisfying $0 \leqq x \leqq 3$, $0 \leqq a \leqq 10$, $0 \leqq y \leqq 20$, $2 \leqq z \leqq 25$.

10. A soft magnetic alloy strip according to claim 9, wherein a part of Fe is replaced by at least one element selected from Co and Ni.

11. A soft magnetic alloy strip according to claim 9, wherein a part of B is replaced by at least one element selected from the group consisting of Al, Ga, Ge, P. C, Be, and N.

12. A soft magnetic alloy strip according to claim 9, wherein a part of M is replaced by at least one element selected from the group consisting of Mn, Cr, Ag, Zn, Sn, In, As, Sb, Sc, Y, platinum group elements, Ca, Na, Ba, Sr, Li, and rare earth elements.

13. A soft magnetic alloy strip according to claim 9, wherein said strip is nano-crystalline soft magnetic alloy strip having structure in which crystal grains not more than 50 nm in grain size occupy at least 50% of said structure.

14. A magnetic member formed by winding or laminating a soft magnetic alloy strip as claimed in any one of claims 1 to 4, 6, to 8 and 10 to 13.

15. A magnetic member formed by winding or laminating a soft magnetic alloy strip as claimed in claim 5.

16. A magnetic member formed by winding or laminating a soft magnetic alloy strip as claimed in claim 9.

17. A manufacturing method of a soft magnetic alloy strip, comprising the steps of:

ejecting an alloy melt from a nozzle having a slit onto a rotating metallic cooling roll to thereby manufacture the alloy strip by a single roll method;

maintaining a surface temperature of the cooling roll within a range of not less than 80° C. but not more than 300° C. in a period of time elapsing 5 seconds or more after the melt was ejected onto said roll; and peeling solidified alloy off the cooling roll at a location spaced within a range of 100 mm to 1500 mm along a roll periphery apart from a roll position immediately beneath the nozzle slit.

18. A method of manufacturing a soft magnetic alloy strip by ejecting an alloy melt onto a rotating, metallic cooling roll from a nozzle having a slit to thereby manufacture said alloy strip by a single roll method, wherein a surface temperature of the cooling roll in a period of time elapsing 5 seconds or more after the melt was ejected onto said roll is maintained to be not less than 80° C. but not more than 300° C., ejected melt pressure being not less than 270 gf/cm$^2$ during the ejecting of said alloy melt, peripheral speed of the cooling roll being not less than 22 m/s, and peeling-off of said alloy strip is performed at a location spaced within a range of 100 mm to 1500 mm along a roll periphery apart from a roll position immediately beneath the nozzle slit.

19. A manufacturing method of a soft magnetic alloy strip according to claim 17 or claim 18, wherein the peeling-off of said soft magnetic alloy strip from the cooling roll is performed at a location spaced within a range of 150 mm to 1000 mm along a roll periphery from a roll position immediately beneath a nozzle slit.

20. A manufacturing method of a soft magnetic alloy strip according to claim 17 or 18, wherein a cooling roll surface temperature is maintained to be not less than 100° C. but not more than 250° C.

21. A manufacturing method of a soft magnetic alloy strip according to claims 17 or 18, wherein a metallic cooling roll is water-cooled in an interior of said roll, and a water quantity for cooling said roll is not less than 0.1 m$^3$/minute but not more than 10 m$^3$/minute.

22. A manufacturing method of a soft magnetic alloy strip according to claim 18, wherein a gap between said cooling roll and said nozzle tip end during the ejecting of said alloy melt is not less than 20 $\mu$m but not more than 200 $\mu$m.

23. A manufacturing method of a soft magnetic alloy strip according to claim 18 or 22, wherein an ejected melt pressure is not less than 350 gf/cm$^2$ but not more than 450 gf/cm$^2$, and a peripheral speed of said cooling roll is not less than 22 m/s but not more than 40 m/s.

* * * * *